US006946159B2

(12) United States Patent
Takahashi et al.

(10) Patent No.: US 6,946,159 B2
(45) Date of Patent: Sep. 20, 2005

(54) MANUFACTURING METHOD FOR ELECTRON-EMITTING DEVICE, ELECTRON SOURCE, AND IMAGE-FORMING APPARATUS

(75) Inventors: Yasuo Takahashi, Tokyo (JP); Naoko Miura, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 226 days.

(21) Appl. No.: 10/236,935

(22) Filed: Sep. 9, 2002

(65) Prior Publication Data

US 2003/0087036 A1 May 8, 2003

Related U.S. Application Data

(62) Division of application No. 09/935,588, filed on Aug. 24, 2001, now Pat. No. 6,506,440, which is a division of application No. 08/626,757, filed on Apr. 2, 1996, now Pat. No. 6,296,896.

(30) Foreign Application Priority Data

Apr. 3, 1995 (JP) ..... 7-99497
Oct. 6, 1995 (JP) ..... 7-284377

(51) Int. Cl.[7] ..... B05D 5/12
(52) U.S. Cl. ..... 427/77
(58) Field of Search ..... 427/58, 64, 66, 427/68, 77

(56) References Cited

U.S. PATENT DOCUMENTS 4,965,092 A 10/1990 Hayduk et al. ..... 427/66
5,066,883 A 11/1991 Yoshioka et al. ..... 313/309
5,106,417 A * 4/1992 Hauser et al. ..... 524/104
5,185,554 A * 2/1993 Nomura et al. ..... 313/495
5,281,450 A * 1/1994 Yaniv ..... 427/510
5,895,692 A * 4/1999 Shirasaki et al. ..... 427/557
6,017,259 A 1/2000 Motoi et al. ..... 445/51
6,060,113 A 5/2000 Banno et al. ..... 427/78
6,123,876 A 9/2000 Kobayashi et al. ..... 252/519.2
6,184,610 B1 2/2001 Shibata et al. ..... 313/309
6,296,896 B1 10/2001 Takahashi et al. ..... 427/226
6,506,440 B2 * 1/2003 Takahashi et al. ..... 427/77

FOREIGN PATENT DOCUMENTS

EP 0693766 1/1996
JP 1283749 5/1988
JP 64031332 2/1989
JP 2257552 3/1989
JP 1200532 8/1989

OTHER PUBLICATIONS

Advances in Electron Physics, W.P. Dyke et al., vol. 8, pp. 89–185 (1956), "Field Emission".

Journal of Applied Physics, C.A. Spindt et al., vol. 47, No. 12, pp. 5248–5263, (1976) "Physical Properties of Thin–Film Field Emission cathodes with Molybdenum C nes".

Journal of Applied Physics, C.A. Mead, vol. 32, pp. 646–652, "Operation of Tunnel–Emission Devices" (1961).

Radio Engineering and Electronic Phyics, M.I. Elinson et al., vol. 10, pp. 1290–1296, 1965, "The Emission of Hot Electrons and the Field Emission of Electrons from Tin Oxide".

(Continued)

*Primary Examiner*—Shrive P. Beck
*Assistant Examiner*—Michael Cleveland
(74) *Attorney, Agent, or Firm*—Fitzpatrick, Cella, Harper & Scinto

(57) ABSTRACT

A method for manufacturing an electron-emitting device processing an electroconductive film upon which an electron-emission region is formed is characterized in that the formation process of formation of the electron-emission region includes a process of application of metal compound-containing material and film thickness controlling agent to the substrate.

2 Claims, 15 Drawing Sheets

OTHER PUBLICATIONS

Thin Solid Films, G. Dittmer, vol. 9, pp. 317–328 (1972), "Electrical Conduction and Electron Emission of Discontinuous Thin Films".

International Electron Devices Meeting, 1975, M. Hartwell et al., pp. 519–521, "Strong Electron Emission From Patterned Tin–Indium Oxide Thin Films".

Journal of the Vacuum Society of Japan, vol. 26, No. 1, pp. 22–29, (1983) H. Araki et al., "Electroforming and Electron Emission of Carbon Thin Films".

* cited by examiner

MANUFACTURING METHOD FOR ELECTRON-EMITTING DEVICE, ELECTRON SOURCE, AND IMAGE-FORMING APPARATUS

This application is a division of Application Ser. No. 09/935,588, filed Aug. 24, 2001, now U.S. Pat. No. 6,506,440 which is a division of application Ser. No. 08/626,757, filed Apr. 2, 1996, now U.S. Pat. No. 6,296,896 B1, issued Oct. 2, 2001.

BACKGROUND OF THE INVENTION

1. Field of the Invention

The present invention relates to the manufacturing method of an electron-emitting device, and more particularly, to electron sources, display panels, and image forming apparatuses, employing the aforementioned electron image device.

2. Related Background Art

Conventionally, two types of electron emission devices have been known; i.e., thermionic type and cold cathode type. Types of cold cathode electron-emitting devices include; field emission type devices (hereafter referred to as "FE type device"), metal/insulator/metal type devices (hereafter referred to as "MIM device"), surface conduction electron-emitting devices (hereafter referred to as "SCE device"), etc.

Known examples of reports of FE type devices include: W. P. Dyke & W. W. Dolan, "Field emission", Advance in Electron Physics, 8, 89(1956); and "Physical properties of thin-film field emission cathodes with molybdenum cones", J. Appl. Phys., 47, 5248(1976); etc. Known examples of reports of MIM devices include: C. A. Mead, "The tunnel-emission amplifier" A. Appl. Phys., 32. 646(1961); etc. Known examples of reports of SCE type devices include: M. I. Elinson, Radio Eng. Electron Phys., 10, (1965); etc.

The SCE device takes advantage of the phenomena where electron emission occurs when an electric current is caused to flow parallel to a thin film, this thin film of a small area being formed upon a substrate. As for examples of such surface conduction electron-emitting devices, in addition to the device by the aforementioned Elinson et al using $SnO_2$ thin film, there have been reported those which use Au thin film [G. Dittmer: "Thin Solid Films", 9,317(1972)], $In_2O_3/SnO_2$ thin film [M. Hartwell and C. G. Fonstad: "IEEE Trans. ED Conf.", 519(1975)], and carbon thin film [Hisashi Araki et al: Shinku, Volume 26, No. 1, page 22 (1983)], etc.

FIG. 18 illustrates the construction of the aforementioned Hartwell device as a classical example of such a surface conduction electron-emitting device. In this Figure, the numeral 1 denotes a substrate. The numeral 4 denotes an electroconductive film formed by sputtering in an H-shaped form of metal oxide thin film, etc., and the electron-emitting region 5 is formed by a later-mentioned current conduction treatment called energization forming. In this Figure, the spacing L between the device electrodes is set to be 0.5 to 1 mm, and the device width W' is set at approximately 0.1 mm. The form of the electron-emitting region 5 has been illustrated in a type drawing.

Conventionally, with these surface conduction electron-emitting devices, it has been common to form the electron-emitting region 5 by conducting a current conduction treatment called energization forming on the electroconductive film 4 beforehand; i.e., energization forming refers to the process of applying either a direct current or an extremely slow rising voltage, such as around 1V/minute, to both edges of the electroconductive film 4 so as to cause local destruction, deformation, or deterioration, thereby forming an electron-emitting region 5 having high electrical resistance. Further, regarding the electron-emitting region 5, a fissure has formed at one portion of the electroconductive film 4, and electron emission occurs from the proximity of this fissure. The member which has been subjected to local destruction, deformation, or deterioration, by means of energization forming upon the conductive film is referred to as the electron-emitting region 5, and the conductive film 4 upon which the electron-emitting region 5 has been formed by means of energization forming is referred to as the electroconductive film 4 which contains the electron-emitting region 5. The aforementioned surface conduction electron-emitting device which has been subjected to energization forming one where voltage is applied to the electroconductive film 4 which contains the electron-emitting region 5, and electrical current is caused to flow through the aforementioned device, thereby causing emission of electrons from the electron-emitting region 5.

Further, the aforementioned surface conduction electron-emitting device has the advantage of enabling arrayed formation of a great number of devices over a wide area, due to the construction thereof being simple and the manufacturing thereof being relatively easy. Accordingly, many applications for employing this advantage have been researched, a few examples being charged beam source and display apparatuses. An example of a great number of surface conduction electron-emitting devices being arrayed is the electron source of the so-called ladder-type device, wherein, as described later, both edges of individual surface conduction electron-emitting devices arrayed in a parallel manner are wired together by means of wiring (common wiring) so as to create a row, and many such rows being arrayed (e.g. Japanese Patent Laid-Open Application No. 1-031332, Japanese Patent Laid-Open Application No. 1-283749, Japanese Patent Laid-Open Application No. 2-257552, etc.). Also, while in recent years image forming apparatuses such as display apparatuses which are flat-type display apparatuses employing liquid crystal have become commonplace in the stead of CRT apparatuses, such flat-type display apparatuses employing liquid crystal have problems such as requiring back lightning due to not being emission type, and development of an emission type display apparatus has been awaited. An example which can be given of an emission type display apparatus is an image-forming apparatus with a display panel which is comprised of an electron source of many arrayed surface conduction electron-emitting devices, and fluorescent substance which is caused to emit visible light by means of the electrons emitted from the electron source (e.g. U.S. Pat. 5,066,883).

The known method employed for the manufacturing of electron-emitting devices such as described above has been a photo-lithographic process according to known semiconductor processes.

While the aforementioned surface conduction electron-emitting device can be applied to image-forming apparatuses and other such apparatuses by means of creating and arraying a great number of such surface conduction electron-emitting devices upon a substrate with a wide area, such an arrangement manufactured with known photo-lithographic processes would result in extremely high costs. Accordingly, it has been necessary to employ a manufacturing method with lower costs. To this end, a method has been suggested as a method for forming such devices on a substrate with a wide area, wherein printing technology is employed for forming the electrodes 2 and 3, and formation of the electron-emitting film 4 is conducted by employing an ink-jet method in which droplets of a solvent containing organic metal compounds are deposited onto the substrate in a partial manner (e.g., Japanese Patent Application No. 6-313439 and Japanese Patent Application No. 6-313440).

Now, description of an overview of the manufacturing process for electron-emitting devices employing printing technology and ink-jet method will be given with reference to FIGS. 3A through 3E.

1) An insulating substrate 1 is thoroughly washed with detergent, pure water, and organic solvent, following which device electrodes 2 and 3 are formed upon the surface of the aforementioned insulating substrate 1, employing screen printing technology or offset printing technology (FIG. 3A).
2) Droplets of a solution containing such as organic metal compounds, for example, are deposited at the gap portion of the device electrodes 2 and 3 on the insulating substrate, employing droplet-depositing means, so that the deposited droplets connect both electrodes upon which they are deposited. This substrate is dried and baked, so as to form the electroconductive thin film 4 for forming the electrode-emitting region (FIG. 3D).

However, depositing droplets upon the printed electrodes employing an ink-jet method results in problems such as follows; i.e., in an event where the density of the printed electrode is low, a phenomena may occur where the deposited droplets penetrate into the electrode by capillary action. This causes the amount and spread of the liquid to be irregular at the gap portion, causing irregularities in the thickness of the electroconductive film after baking, irregularity in film thickness from one device to another, and irregularities in electric properties.

Also, while this is not a problem confined to the ink-jet method, in the event that the surface conditions of the substrate are not uniform or the wettability of printed electrodes and the substrate are not the same, the droplets are repelled, making formation of a uniform film to be difficult.

Further, when employing the ink-jet method to formation of a later-described large-area display apparatus, it becomes necessary to deposit a great number of droplets upon the substrate in order to form a great number of electroconductive films. Accordingly, the amount of time elapsed following depositing of the droplets upon the substrate, during which time the deposited droplets are left to stand, differs between each of the electroconductive films. Consequently, the organic metal compounds contained within the droplets crystallize, which may cause non-conformity in post-baking film thickness of the electroconductive films and irregularity in the resistance of each of the electroconductive films corresponding to each of the devices.

Moreover, as described in Japanese Patent Laid-Open Application No. 1-200532, regarding manufacturing methods of electron-emitting devices, in order to obtain electroconductive film comprising fine particles of metals or metal oxides to which energization forming processing can be applied, a process has been conducted wherein a thin film of an organic metal compound such as palladium acetate is formed between the device electrodes, following which a baking process referred to as baking is applied to the electroconductive thin film. This known baking process is conducted in order to form a thin film from fine particles of metal or metal oxide due to heat decomposition of the organic metal compound in an atmosphere of air, etc. The heat processing temperature of this known method has been a temperature higher than the melting point or the decomposition point of the organic metal compound.

As a result of the known process, wherein the electroconductive thin film of the organic metal compound is heated to a temperature higher than the melting point or the decomposition point thereof in order to obtain an electroconductive film before conducting energization forming, part of the metal contained within the organic metal compound is lost either to volatilization or sublimation, resulting on thinning of the thickness of the obtained thin film of fine particles of metal or metal oxide, and further creating a problematic situation wherein precise control of the film thickness is difficult.

Further yet, in the event where non-volatile organic compounds are employed for formation of the electroconductive film, crystal precipitation and deformation of the droplets occur during the drying process, making for irregularities in the film thickness, again resulting in a problem wherein precise control of the film thickness is difficult.

Moreover, in the manufacturing process of image-forming apparatuses wherein multiple electron-emitting devices are arrayed, difference in the thickness of the formed electron-emitting devices arises owing to the fact that there is difference in the time from when droplets are deposited on each device till the baking process.

Consequently, in surface conduction electron-emitting devices manufactured according to the aforementioned method, there is great irregularity in the thickness of the electroconductive films and electric properties such as sheet resistance value, thereby resulting in occurrence of brightness irregularities and defective products in resultant electron sources, display panels, and image-forming apparatuses, using the electron-emitting devices.

SUMMARY OF THE INVENTION

The present invention has been made in view of the aforementioned problems, and the object thereof is to prevent the following: seepage of droplets owing to printed electrodes; or non-uniform spreading of the droplets due to wettage distribution upon the substrate or difference in wettage between the substrate and the electrodes; or precipitation of crystals due to the difference in time from the droplet deposition to the baking process and volatilization or sublimation; thereby developing a manufacturing method for an electron-emitting device of which the thinning of the electroconductive film can be lessened and irregularities in electrical properties such as sheet resistance value can be minimized, and to further provide for a manufacturing method for electron sources, display panels, and image-forming apparatuses, using the same method.

According to an aspect of the present invention, there is provided a method for manufacturing an electron-emitting device processing an electroconductive film upon which an electron-emission region is formed, wherein the formation process of formation of the electron-emission region includes a process of application of metal compound-containing material and film thickness controlling agent to the substrate.

According to another aspect of the present invention, there is provided a method for manufacturing an electron source comprising: a substrate; and a plurality of electron-emitting devices arrayed upon the substrate;

wherein the electron-emitting devices are manufactured according to the method for manufacturing the electron-emitting device.

According to still another aspect of the present invention, there is provided a method for manufacturing an image-forming apparatus comprising: a substrate; an electron source comprised of a plurality of electron-emitting devices arrayed upon the substrate, and an image-forming member;

wherein the electron-emitting devices are manufactured according to the method for manufacturing an electron-emitting device.

DETAILED DESCRIPTION OF THE PREFERRED EMBODIMENTS

The preferable form of the present invention will be described below, with reference to examples.

According to the manufacturing method of the electron-emitting device of the present invention, electroconductive film forming material containing organic metal compound and/or non-organic metal compound as a main ingredient thereof is deposited upon a substrate in the form of droplets. While any means for depositing the aforementioned material upon the substrate is acceptable so long as depositing can be conducted while forming droplets of the aforementioned material, the ink-jet method is preferable for the following points: particularly minute droplets can be generated and deposited in an effective and appropriately precise manner, and controllability is also good. With the ink-jet method, minute droplets of around 10 nanograms to around tens of nanograms can be generated with high reproducability, and deposited on the substrate. There are generally two types of ink-jet systems: one is the bubble-jet method where the application material is heated to the point of boiling by means of a heating resistor so that droplets are sprayed from a nozzle; the other is the piezo-jet method where the application material is sprayed from a nozzle due to the contraction pressure of piezo devices provided to the nozzles.

With the manufacturing method of the electron-conformity emitting device of the present invention, in addition to the aforementioned electroconductive film forming material being deposited upon a substrate in the form of droplets, a decomposer for decomposing the aforementioned material and/or an aqueous solution containing aqueous resin is deposited upon a substrate in the form of droplets. As with the depositing means for the aforementioned material, it is preferable that the means for depositing the aforementioned decomposer and/or the aqueous solution containing aqueous resin upon the substrate also be an ink-jet method such as bubble-jet or piezo-jet.

Figure 13:
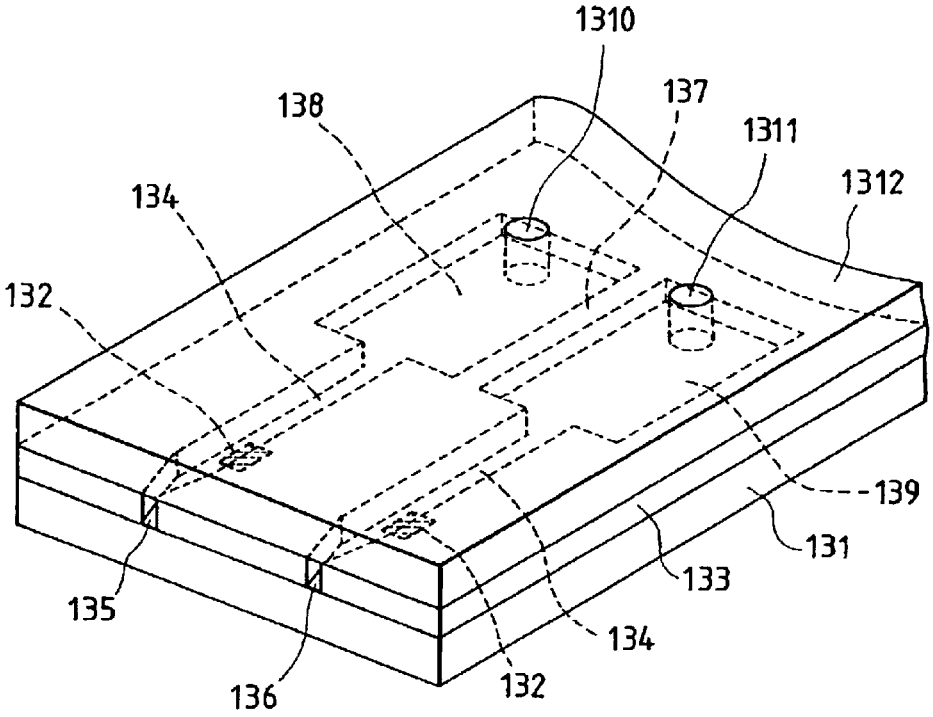
FIG. 13 is a schematic drawing of a multi-nozzle type buble-jet manufacturing apparatus relating to the present invention.
Figure 14:
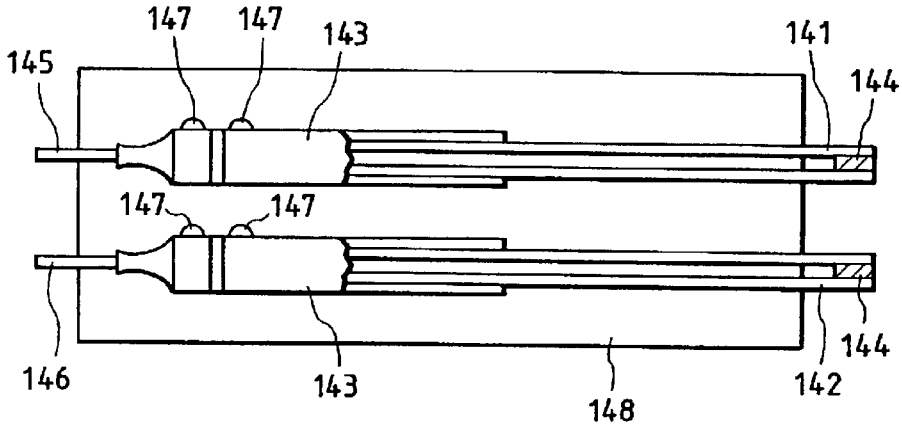
FIG. 14 is a schematic drawing of a multi-nozzle type piezo-jet manufacturing apparatus relating to the present invention.

Consequently, with the manufacturing method of the electron-emitting device of the present invention, it is preferable that a multi-nozzle ink-jetter be employed which has depositing means for the aforementioned electroconductive film forming material and depositing means for the aforementioned decomposer and/or aqueous solution containing aqueous resin. FIGS. 13 and 14 illustrate examples of multiple-nozzle type bubble-jetters used preferably with the present invention. FIG. 13 illustrates a multiple-nozzle type bubble-jetter, and in the same Figure, reference numeral 131 denotes a substrate, reference numeral 132 denotes a heat-generating portion, reference numeral 133 denotes a photosensitive resin dry film (50 $\mu$m in thickness), reference numeral 134 denotes a liquid path, reference numeral 135 denotes a No. 1 nozzle, reference numeral 136 denotes a No. 2 nozzle, reference numeral 137 denotes a partition wall, reference numeral 138 denotes a chamber for electroconductive film forming material, reference numeral 139 denotes a decomposer chamber, reference numeral 1310 denotes an electroconductive film forming material supply aperture, reference numeral 1311 denotes a decomposer supply aperture, and 1312 denotes a top plate. Further, FIG. 14 illustrates a multi-nozzle type piezo-jetter, in which Figure reference numeral 141 denotes a glass No. 1 nozzle, reference numeral 142 denotes a glass No. 2 nozzle, reference numeral 143 denotes a cylindrical piezo, reference numeral 144 denotes a filter, reference numeral 145 denotes a tube for supplying electroconductive film forming material, reference numeral 146 denotes a tube for supplying decomposer, reference numeral 147 denotes an electrical signal, and reference numeral 148 denotes an ink-jet head.

Figure 15:
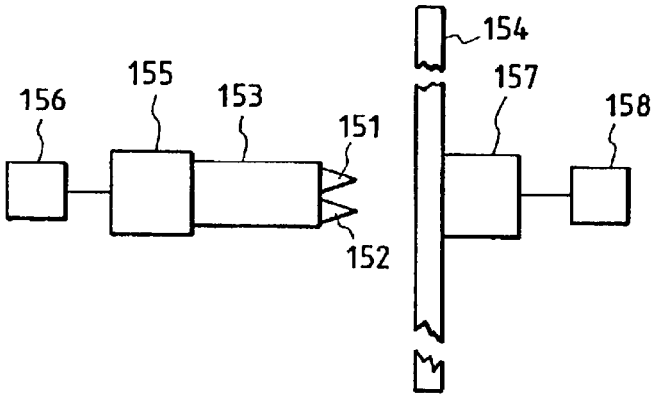
FIG. 15 is a model drawing of the droplet-depositing process using a multi-nozzle type ink-jet manufacturing apparatus relating to the present invention.

Further yet, FIG. 15 illustrates a model of one example of the method of employing a multi-nozzle type ink-jetter preferably used with the present invention in order to deposit the electroconductive film forming material and the decomposer and/or aqueous solution containing aqueous resin. In FIG. 15, reference numeral 151 denotes a No. 1 nozzle, reference numeral 152 denotes a No. 2 nozzle, reference numeral 153 denotes an ink-jet head, reference numeral 154 denotes an electronic circuit substrate for forming electroconductive film, reference numeral 155 denotes an ink-jet drive apparatus, reference numeral 156 denotes an eject position control apparatus, reference numeral 157 denotes a substrate drive apparatus, and reference numeral 158 denotes a substrate position control apparatus.

Moreover, while FIGS. 13 through 15 show a multi-nozzle type ink-jetter provided with a No. 1 nozzle which ejects electroconductive film forming material, and a No. 2 nozzle which ejects decomposer and/or aqueous solution containing aqueous resin, No. 3 and No. 4 nozzles may be further provided as necessary to conduct ejecting of other decomposers and/or aqueous solutions containing aqueous resin. Particularly, when multiple types of decomposer are to be employed it is preferable that separate nozzles be provided for each decomposer.

Moreover yet, deposition of the electroconductive film forming material, the decomposer for the electroconductive film forming material, and the aqueous solution containing aqueous resin may be conducted either simultaneously or sequentially. In the event that the deposition is to be conducted sequentially, any of the following orders may be used:

Aqueous solution containing aqueous resin→ Electroconductive film forming material Electroconductive film forming material→ Decomposer for electroconductive film forming material Decomposer for electroconductive film forming material→ Electroconductive film forming material Aqueous solution containing aqueous resin→ Electroconductive film forming material→ Decomposer for electroconductive film forming material Aqueous solution containing aqueous resin→ Decomposer for electroconductive film forming material → Electroconductive film forming material, the order thereof being selected appropriately according to the type of material, etc., being used for the electron-emitting device. Also, in the event that the concentration of these materials are limited due to limitations regarding droplet deposition or material solubility, the aforementioned droplet deposition may be conducted multiple times.

Next, the composition and characteristics of the aforementioned "aqueous solution containing aqueous resin" will be described.

The aqueous solution employed in the present invention is characterized by containing aqueous resin therein, and the viscosity of the solution increases by means of drying or heating the solvent or due to polymeric reaction of the aqueous resin. It is preferable that the initial viscosity for deposition to the substrate be between 2 to 10 centipoise. This is the preferable viscosity for depositing solution droplets onto the substrate by means of the ink-jet method. It is desirable that the viscosity following heating be 100 centipoise or greater.

The following are other conditions desired of the aqueous solution:

1. That the solution which has increased in viscosity due to heating does not lose that viscosity even having been cooled to room temperature.
2. That the aqueous resin within the aqueous solution of which the viscosity has increased decomposes at a temperature lower than the baking temperature of the organic metal compound, and that following decomposition thereof there is no residue left upon the substrate. Consequently, it is desirable that metal salts including metal elements, such as potassium, sodium, etc. are not employed.

Aqueous resins which fulfill the above conditions include acrylic acid derivative resins, alcohol acid derivative resins, cellulose derivative resins, and dextrins, such as methyl cellulose, hydroxyethyl cellulose, carboxymethyl cellulose, dextrin, acrylic acid, methacrylic acid, polyvinyl alcohol, polyethylene glycol, etc.

While any means for depositing the aforementioned aqueous solution upon the substrate is acceptable so long as depositing can be conducted while forming droplets of the solution, the ink-jet method is preferable since particularly minute droplets can be generated and deposited in an effective and appropriately precise manner, and controllability is also good. This is a most preferable method, since minute droplets of around 10 nanograms to around tens of nanograms can be generated with high reproducability, and deposited where desired. The deposition thereof is conducted upon the substrate between electrodes and to a certain portion upon the electrodes. The region to which deposition is conducted is the region to which the solution containing the organic metal compound is deposited, plus a range of approximately 10 $\mu$m in addition at the perimeter thereof. The deposited aqueous solution penetrates into the electrode, following which the viscosity thereof is increased by means of drying or heating, thereby being maintained in gaps within the electrode, filling the gaps. In the event of heating, it is preferable that the heating temperature be 200° C. or lower. The substrate is cooled again following heating, and the solution containing organic metal compounds is deposited. The deposited solution does not penetrate into the electrodes, but rather adheres to the predetermined position upon the electrodes and in the gap between the electrodes. A further baking process forms the electroconductive film.

Next, the composition and characteristics of the aforementioned "the decomposer" will be described.

As for the decomposer used with the present invention, the following can be given: reducing decomposers, oxidizing decomposers, hydrolytic decomposers, catalytic decomposers, acid decomposers, and alkali decomposers. Regarding reducing decomposers, it is desirable that at least one type or more be selected from the group of the following: formic acid, acetic acid, oxalic acid, aldehydes, hydrazine, and carbon black. Regarding oxidizing decomposers, it is desirable that at least one type or more be selected from the group of the following: nitric acid, and aqueous hydrogen peroxide. Regarding hydrolytic decomposers, it is desirable that at least one type or more be selected from the group of the following: water, aqueous acid solution, and aqueous alkali solution. Regarding catalytic decomposers, aluminum oxide is desirable.

Although the decomposers used with the present invention may be used either singularly or in multiple, and may be used as a solution or dispersant for water or organic solvents, when application to the aforementioned ink-jet method is taken into consideration, an aqueous solution or dispersant is preferable.

When multiple decomposers are to be used simultaneously, e.g., when a reducing decomposer and a catalytic decomposer are to be both added, formic acid is preferable for the reducing decomposer, nitric acid is preferable for the oxidizing decomposer, and aqueous ammonia is preferable for the hydrolytic decomposer.

The amount of decomposer to be ejected is preferably 0.01 to 10 parts by weight to 1 part by weight of the electroconductive film forming material, and more desirably 0.1 to 2 parts by weight. If the amount of decomposer being ejected is less than 0.01 parts by weight the decomposition will either be too slow or be incomplete, and if the amount of decomposer being ejected is more than 10 parts by weight the droplets of the aforementioned material become large in diameter, resulting in an undesirable situation in which the film thickness is too thin. Solid decomposers such as carbon black are suspended in water or organic liquids and thus ejected.

Metal compounds such as the aforementioned organic metal compounds regarding the present invention are generally insulating, and cannot undergo the later-described energization forming process as such. Thus, the method of the present invention involves decomposing the aforementioned material deposited upon the substrate by means of the aforementioned decomposer, thereby obtaining an electroconductive film of metal and/or organic metal compound. It is preferable that the aforementioned decomposition process relating to the present invention is a selection of at least one or more of the group comprised of the following: reduction decomposing, oxidization decomposing, hydrolytic decomposing, catalytic decomposing, acid decomposing, and alkali decomposing. With the method of the present invention, since a decomposer is deposited for the electroconductive film forming material as described above, an electroconductive film containing metal and/or organic metal compound can be obtained without conducting heat processing at a temperature higher than the melting temperature or decomposing temperature of the materials.

Further, with the method of the present invention, in addition to the aforementioned process of decomposition processing by means of decomposers, photo-decomposition and/or radiant heat decomposition processing can be conducted, and further, a combination of methods can be used, e.g., conducting both decomposition processing using a hydrolytic decomposer and radiant heat decomposition. As for radiant heat processing, a preferable method is irradiation of infra-red rays, and for photo-decomposition, preferable methods are irradiation of ultra-violet rays or visible light. When photo-decomposition and/or radiant heat decomposition processing in this manner in addition to the aforementioned decomposition processing employing decomposers, it is desirable to provide the radiant heat source for conducting radiant heat decomposition or the light source for conducting photo-decomposition at the nozzle of the aforementioned multi-nozzle ink-jetter, and to conduct irradiation either simultaneously with ejecting of the electroconductive film forming material and/or ejecting of the decomposer, or sequentially.

With the method of the present invention, it is preferable to follow the aforementioned decomposition processing with a baking process whereby the aforementioned material is heated to a low temperature lower than the melting point or decomposition point thereof, preferably 100° C. or lower, thereby forming a metal compound thin film. Then, it is desirable to heat the metal compound thin film to a medium temperature of preferably around 150° C. to 200° C., so as to conduct volatile removal of moisture and low-temperature volatile materials, etc. Further, according to the method of the present invention, it is desirable to follow the above baking process with a further baking process, preferably at a high temperature around 300° C., so as to change the metal compounds to oxides. It is preferable that this heat processing be 10 minutes or longer. Since the metal compounds relating to the present invention have already been decomposed into fine metal particles beforehand, there is no loss of part of the metal due to volatilization or sublimation from decomposition of the metal compound during the baking process as there has been with known process, even though the baking process of the method of the present invention is conducted at around 300° C.

Moreover, it is preferable that 90% or more of the organic constituents of the aforementioned organic metal compound decomposes during the aforementioned decomposing process; i.e., 90% or more of the organic metal compound be of non-organic metal and/or metal non-organic compound. This is because that there is an inclination that within this range, the electric resistance of the obtained electroconductive film becomes low, so that energization forming processing can be conducted without fail. The organic material used for the remaining portion (the constituent preferably 10% or less) is such as $H_2O$, CO, $NO_x$, etc. However, depending on the main metal within the organic metal compound, the metal may cause adhesion, occlusion, or arrangement thereof, so that it becomes impossible to completely remove. While it is desirable that the residue of such does not exist, such residue is permissible within the range wherein electric resistance allowing energization forming processing can be maintained.

Moreover yet, while the drying process involves employment of generally used methods such as air-drying, ventilation drying, heat drying, etc., such methods being applied as deemed appropriate, and while the baking process involves using generally used heating means, the drying process and the baking process need not be conducted as two separate processes, but may rather be conducted sequentially and simultaneously conducted.

Although the basic construction of electron-emitting devices which can be manufactured according to the manufacturing method of the electron-emitting device of the present invention is not particularly limited, a preferable basic construction of an electron-emitting device will be described below with reference to drawings.

There are two types of construction of electron-emitting devices used preferably with the present invention: one is the flat type, and the other is the step type. First, description will be made of the flat type electron-emitting device.

Figure 1A:
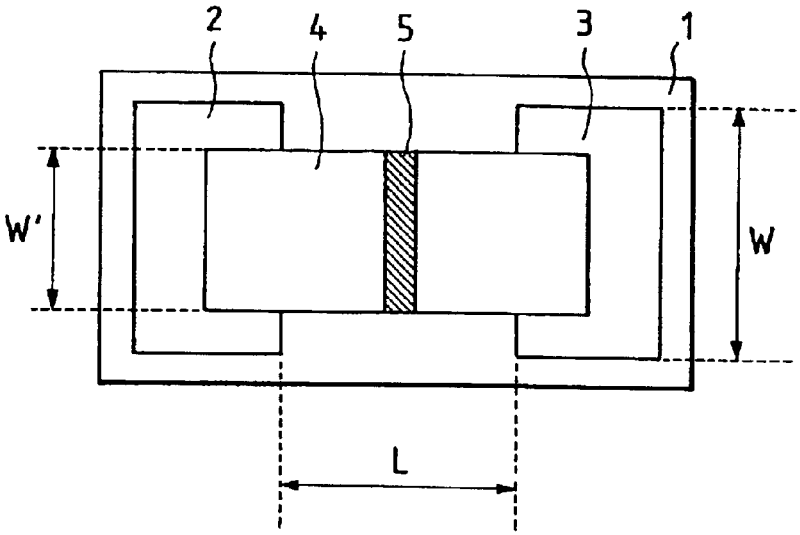
FIG. 1A is a model plan view illustrating the construction of a flat-type electron-emitting device used preferably with the present invention.
Figure 1B:
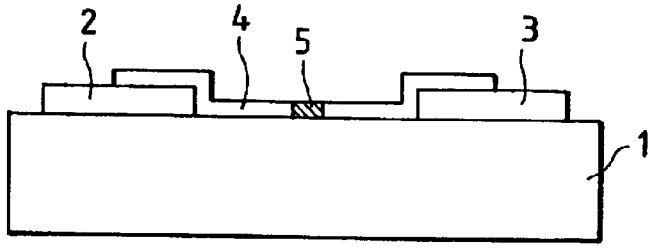
FIG. 1B is a cross-sectional view thereof.

FIG. 1A is a model plan view illustrating the construction of a flat-type electron-emitting device used preferably with the present invention, and FIG. 1B is a cross-sectional view thereof. In FIGS. 1A and 1B, reference numeral 1 denotes an insulating substrate, reference numerals 2 and 3 denote device electrodes, reference numeral 4 denotes an electroconductive film, and reference numeral 5 denotes an electron-emitting region.

Materials used for the substrate 1 include glass substrates such as quartz glass, glass with decreased amounts of impurities such as Na, soda-lime glass, soda-lime glass with $SiO_2$ layered thereupon by means of sputtering, and ceramics, etc., such as almina, etc.

The material of the electrodes 2 and 3 disposed on the substrate 1 so as to oppose each other is selected from the following as appropriate: metals such as Ni, Cr, Au, Mo, W, Pt, Ti, Al, Cu, Pd, etc., or alloys thereof; printing conductive material comprised of metals or metal oxides and glass, such as Pd, Ag, Au, $RuO_2$, Pd—Ag, etc.; transparent electroconductive material such as $In_2O_3$—$SnO_2$; and semiconductor conductive materials such as poly-silicone, etc.

The spacing L of the device electrodes, the length W of the device electrodes, and the form of the electroconductive film 4 is designed as appropriate depending on the form in which the application thereof is to be. The spacing L of the device electrodes preferably is between several hundred angstrom to several hundred μm, and more preferably is several μm to several tens of μm, depending on the voltage applied between the device electrodes, etc. Also, the length W of the device electrodes preferably is between several μm to several hundred μm, depending on the resistance value of the electrodes and the electron emitting properties, etc. Further, the film thickness (d) of the device electrodes 2 and 3 preferably is between several hundred angstrom to several μm.

Also, while FIGS. 1A and 1B shown the device electrodes 2 and 3 and then the electroconductive film 4 being sequentially layered upon the substrate 1 in the above order, the electron-emitting device used preferably with the present invention need not be only of the above construction, but may be of a construction sequentially layered upon the substrate 1 in the order of the electroconductive film 4 and then the device electrodes 2 and 3.

The electroconductive film 4 contains metal non-organic compounds such as metal nitrides, and metals and/or metal oxides formed by the aforementioned decomposition process conducted on the aforementioned electroconductive film forming material of the present invention. Consequently, examples of material comprising the electroconductive film 4 include the following: metals such as Pd, Ru, Ag, Au, Ti, In, Cu, Cr, Fe, Zn, Sn, Ta, W, Pb, Tl, Hg, Cd, Pt, Mn, Sc, Y, La, Co, Ce, Zr, Th, V, Mo, Ni, Os, Rh, and Ir; alloys such as AgMg, NiCu, and PbSn; metal oxides such as PdO, $SnO_2$, $In_2O_3$, PbO, $Sb_2O_3$; metal borides such as $HfB_2$, $ZrB_2$, $LaB_6$, $CeB_6$, $YB_4$, $GdB_4$; and metal nitrides such as TiN, ZrN, HfN. In addition to these, metal carbides such as TiC, ZrC, HfC, TaC, SiC, and WC, semiconductors such as Si and Ge, and carbon, etc., may be included. Further, the metals to be used are selected appropriately in light of the formation of organic metal compounds, aqueous solubility, etc., and the following are used particularly preferably Pd, Ru, Ag, Cu, Fe, Pb, and Zu.

It is particularly preferable that the electroconductive film 4 be comprised of fine particles in order to obtain good electron-emitting properties. The term "thin film compound of fine particles" mentioned here refers to a film comprised of a collection of multiple fine particles, the fine structure thereof being not only a state of fine particles being dispersed individually, but coming into contact with each other or over lapping one another (including such in island form). It is preferable for the diameter of the fine particles of be several angstrom to several thousand angstrom, and particularly preferable to be between 10 angstrom to 200 angstrom.

The film thickness of the electroconductive film 4 is set as appropriate according to conditions such as step coverage to device electrodes 2 and 3, electric resistance value of device electrodes 2 and 3, and latter-described energization forming processing conditions, etc. The film thickness is preferably several angstrom to several thousand angstrom, and particularly preferable to be between 10 angstrom to 500 angstrom. The preferable electric resistance value for the electroconductive film 4 is sheet resistance between $10^3$ to $10^7$ Ω/□.

The electron-emitting region 5 is a high-resistance fissure which has been formed at one portion of the electroconductive film 4, the formation thereof depending on conditions such as the film thickness of the electroconductive film 4, film properties, material, and latter-described energization forming processing conditions, etc. The electron-emitting region 5 may contain electroconductive fine particles from several angstrom in diameter to several hundred angstrom in diameter. These electroconductive fine particles are either partially or totally the same as the elements of the material comprising the electroconductive film 4. Further, the electron-emitting region 5 and the electroconductive film 4 in the periphery of the electron-emitting region 5 may posses carbon and carbon compounds. While in FIGS. 1A and 1B, a part of the electroconductive film 4 is shown to serve as the electron-emitting region 5, the entire electroconductive film 4 between the device electrodes 2 and 3 may be made to serve as the electron-emitting region 5, depending on the manufacturing method.

Next, description will be made of the step type electron-emitting device which is another configuration of an electron-emitting device used preferably with the present invention.

Figure 2:
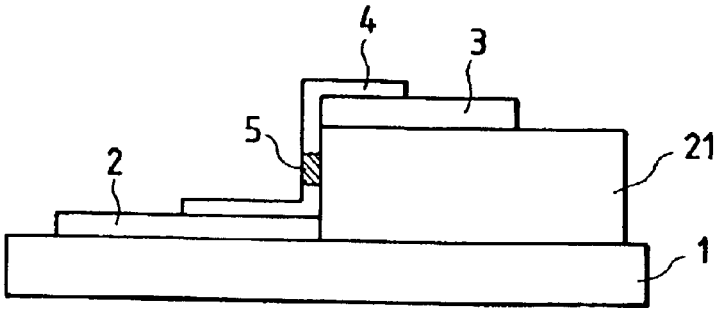
FIG. 2 is a model cross-sectional view illustrating the construction of a step-type electron-emitting device used preferably with the present invention.

FIG. 2 is a model cross-sectional view illustrating the basic construction of a step-type electron-emitting device used preferably with the present invention. In this FIG. 2, the reference numerals which are the same as the reference numerals in FIGS. 1A and 1B illustrate the same items as in FIGS. 1A and 1B, with reference numeral 21 denoting a step-forming section.

The substrate 1, device electrodes 2 and 3, electroconductive film 4, and electron-emitting region 5 are comprised of the same sort of material as the aforementioned flat-type electron-emitting device. The step-forming section 21 is constructed of an insulating material such as $SiO_2$ by means of vacuum evaporation, printing, sputtering, etc. The thickness of the step-forming section 21 corresponds to the spacing L between the device electrodes of the aforementioned flat-type electron-emitting device, preferably being several hundred angstrom to several tens of μm. This thickness is set by the manufacturing method of the step-forming section and the voltage applied between the device electrodes, and is more preferably between several hundred angstrom to several μm.

Since the electroconductive film 4 is formed after fabricating the device electrodes 2 and 3 and the step-forming section 21, the electroconductive film 4 is layered upon the device electrodes 2 and 3. Further, the electron-emitting section 5 is shown in FIG. 2 to be on a straight line with the step-forming section 21, but depends on fabrication conditions and energization forming conditions, etc., and is not limited to such a construction.

Also, any manufacturing methods for the electroconductive film and electron-emitting device of the present invention are permissible as long as the aforementioned conditions are met, with several specific methods being possible, one example of which is illustrated in FIGS. 3A through 3E.

The following is a sequential description of a preferable form of the manufacturing method of the electroconductive film and electron-emitting device of the present invention in the event that a decomposer is used to decompose the electroconductive film forming material, with reference to FIGS. 3A through 3E. In the FIGS. 3A through 3E, the reference numerals which are the same as the reference numerals in FIGS. 1A and 1B illustrate the same items as in FIGS. 1A and 1B.

Figure 3A:
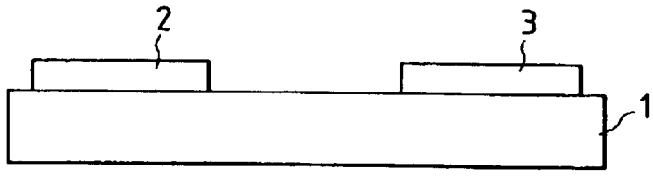
FIGS. 3A through 3E are model cross-sectional views illustrating one example of a manufacturing method of the electron-emitting device of the present invention.

1) A substrate 1 is thoroughly washed with detergent, pure water, and organic solvent, then device electrode material is deposited upon the substrate 1 by means of vacuum evaporation or sputtering, etc., following which device electrodes 2 and 3 are formed upon the aforementioned substrate 1, employing photo-lithography technology (FIG. 3A).

2) Droplets of the aforementioned electroconductive film forming material 32 are deposited by means of the No. 1 nozzle 31 of the multi-nozzle ink-jetter onto the substrate 1 upon which the device electrodes 2 and 3 are formed (FIG. 3B), and at the same time, droplets of the aforementioned decomposer 34 are deposited by means of the No. 2 nozzle 33 (FIG. 3C), thereby forming the metal compound thin film 35. This metal compound thin film is then baked, so as to form the electroconductive film 4 containing fine metal particles and/or fine particles of metal non-organic compound (FIG. 3D).

Figure 3B:
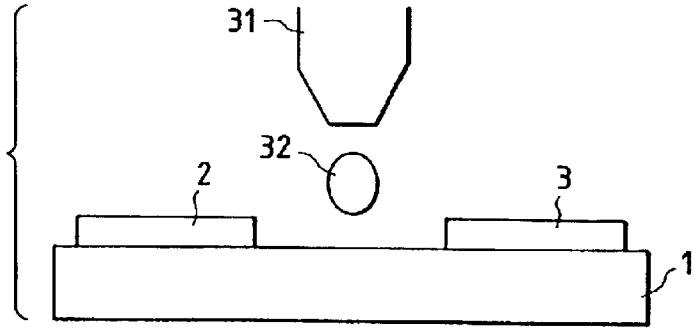
Figure 3C:
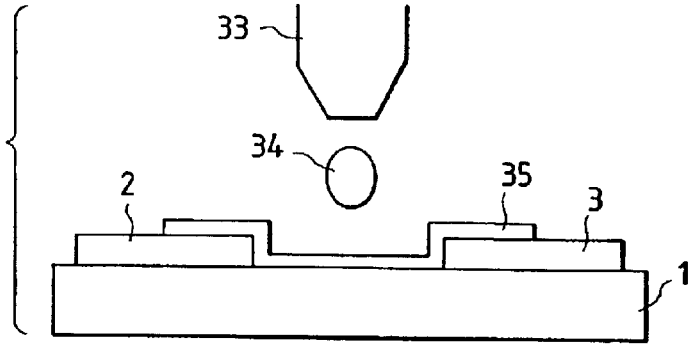
Figure 3D:
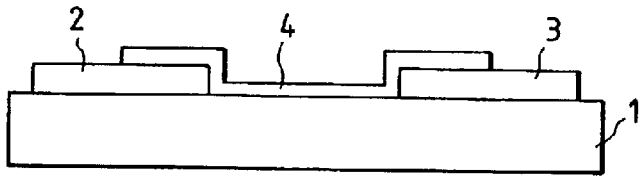
Figure 3E:
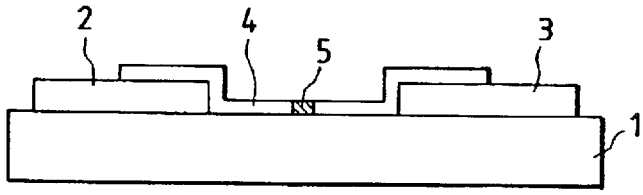

3) Subsequently, current conduction is conducted between the device electrodes 2 and 3 by means of a power source (not shown) so as to subject the electroconductive film 4 to a current conduction treatment called energization forming, thereby forming an electron-emitting region 5 which is a deformed structure in the electroconductive film 4 (FIG. 3E).

Figure 4A:
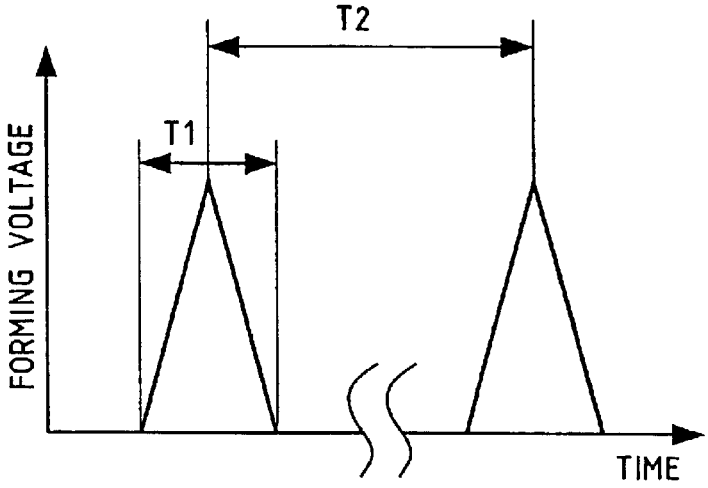
FIGS. 4A and 4B are graphs illustrating examples of voltage waveforms for energization forming preferably used for the present invention.
Figure 4B:
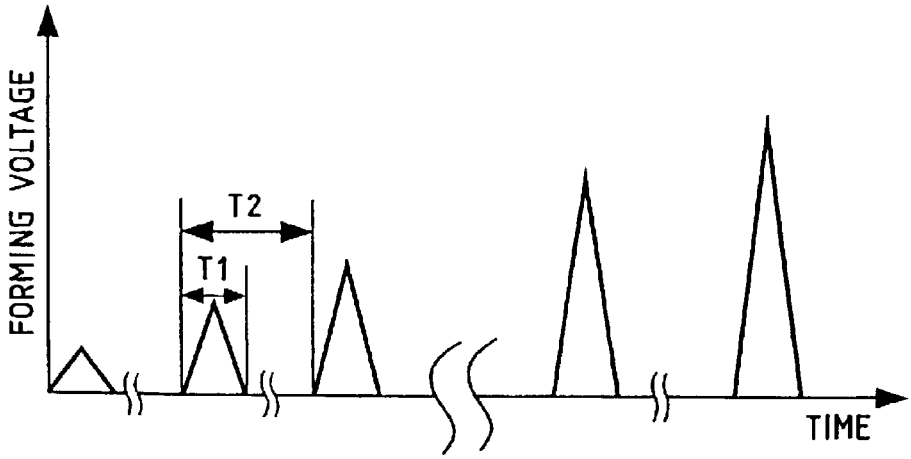

FIGS. 4A and 4B illustrate an example of voltage waveforms for energization forming.

Pulse waves are particularly preferable for the voltage waveform. FIG. 4A illustrates a case where pulses are consecutively applied with the pulse crest value set to be constant-voltage, and FIG. 4B illustrates a case where pulses are applied with the pulse crest value being increased.

First, the case where the pulse crest value set to be constant-voltage will be described with reference to FIG. 4A. T1 and T2 in FIG. 4A denote the pulse width and the pulse interval of the voltage waveform. T1 is set at a value between 1 microsecond to 10 milliseconds, T2 is set at a value between 10 microseconds to 100 milliseconds, the crest value (peak voltage for conducting energization forming) of the triangular wave is appropriately selected according to the aforementioned form of the electron-emitting device, and is applied for several seconds to several tens of seconds, in an appropriate degree of vacuum. Incidentally, the voltage waveform to be applied between the electrodes of the device need not be limited to a triangular form; any waveform, such as rectangular.

T1 and T2 in FIG. 4B are the same as in FIG. 4A, and application is conducted in an appropriate degree of vacuum while increasing the crest value of the triangular wave by around 0.1V steps, for example.

The energization forming is quit in the above case as follows: During the pulse interval T2, a voltage which will not cause local destruction or deformation of the electroconductive film 4, e.g., around 0.1V, is applied and the device current is measured, the electrical resistance is measured, and in the event that a resistance of 1MΩ, for example, is exhibited, the energization forming is quit.

4) Next, preferably, a process called activation is conducted to the device which has finished energization forming.

Activation process refers to a process where application of pulse voltage where the crest value is constant-voltage is repeatedly conducted in the same manner as with energization forming, in a vacuum of $10^{-4}$ to $10^{-5}$ torr or in an atmosphere into which organic gas has been introduced. By means of this processing, carbon and carbon compounds are deposited from the organic matter existing in the vacuum, thereby markedly changing the device current If and emission current Ie. The device current If and emission current Ie are continuously measured, and the activation process is quit at a point such as when the emission current Ie reaches a point of saturation. The pulse crest value is preferably at operating drive voltage.

The term "carbon and carbon compounds" mentioned here refer to graphite (both mono-crystalline and poly-crystalline) and non-crystalline carbon (indicating a mixture of non-crystalline carbon and poly-crystalline graphite), the thickness thereof being preferably 500 angstrom or less, and more preferably being 300 angstrom or less.

5) It is preferable to operate the thus fabricated electron-emitting device in a vacuum atmosphere maintained at a higher degree of vacuum than the degree of vacuum used in the forming process and the activation process. Further, it is preferable to operate the electron-emitting device after heating to a temperature between 80° C. to 300° C. in a vacuum atmosphere at a higher degree of vacuum than the aforementioned degree of vacuum.

A vacuum atmosphere maintained at a higher degree of vacuum than the degree of vacuum used in the forming process and the activation process means a degree of vacuum of $10^{-6}$ or greater, more preferably an ultra-high vacuum system, which is a degree of vacuum at which there is generally no new deposition of carbon or carbon compounds.

Consequently, it is thus possible to inhibit deposition of carbon or carbon compounds beyond what has already been deposited in the aforementioned activation process, thereby stabilizing the device current If and emission current Ie.

Next, a preferable form of the manufacturing method of the electroconductive film and electron-emitting device of the present invention in the event that an aqueous solution containing aqueous resin is deposited upon a substrate will be described, with reference to FIGS. 1A and 1B, and FIGS. 19A through 19D. The reference numerals which are the same as the reference numerals in FIGS. 1A and 1B illustrate the same items therein.

FIGS. 1A and 1B are schematic drawings illustrating one example of an electron-emitting device manufacture by means of the method of the present invention, and FIGS. 19A through 19D are process drawings illustrating one example of the manufacturing method of the electron-emitting device of the present invention.

Figure 19A:
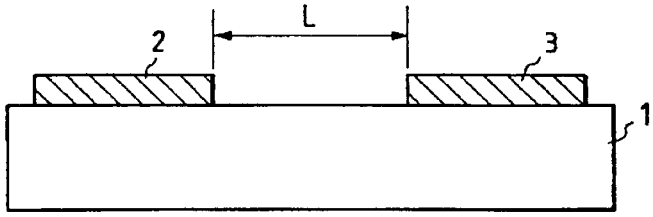
FIGS. 19A through 19D are drawings illustrating one example of the electron-emitting device of the present invention.

1) An insulating substrate 1 is thoroughly washed with detergent, pure water, and organic solvent, following which device electrodes 2 and 3 are formed upon the surface of the aforementioned insulating substrate 1, employing offset printing technology (FIG. 19A).

2) Droplets of an aqueous solution containing aqueous resin are deposited onto part of the device electrodes, employing the ink-jet method (not shown). The region to which deposition is conducted is the region to which the solution containing the organic metal compound is deposited, plus a range of approximately 10 μm in addition at the perimeter thereof.

3) The liquid deposited in Step 2) is dried. If necessary, the substrate is heated until the viscosity increases.

Figure 19B:
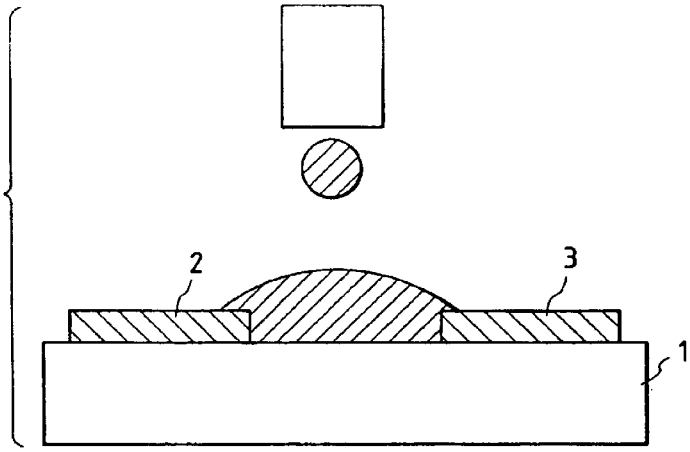

4) Droplets of a solution containing organic metal compound(s) are deposited at the gap portion of the device electrodes 2 and 3 on the insulating substrate, employing the ink-jet method (not shown), so that the deposited droplets do not exceed the region to which the solution of Step 2) is deposited (FIG. 19B).

Figure 19C:
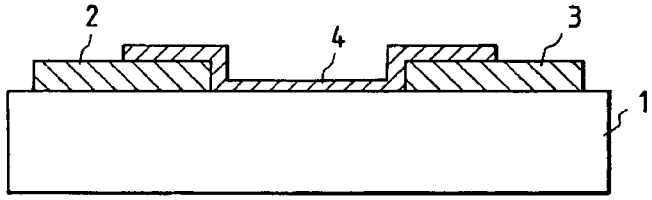

5) This substrate is dried and baked, so as to form the thin film 4 (FIG. 19C). The viscous solution of Step 3) evaporates and decomposes, so that there is no residue left upon the substrate following decomposition.

Next, the subsequent processes are conducted the same as with the preferable form employing the aforementioned decomposer.

The basic properties of an electron-emitting device having the aforementioned device construction and fabricated according to the manufacturing method of the present invention are described with reference to FIGS. 5 and 6.

Figure 5:
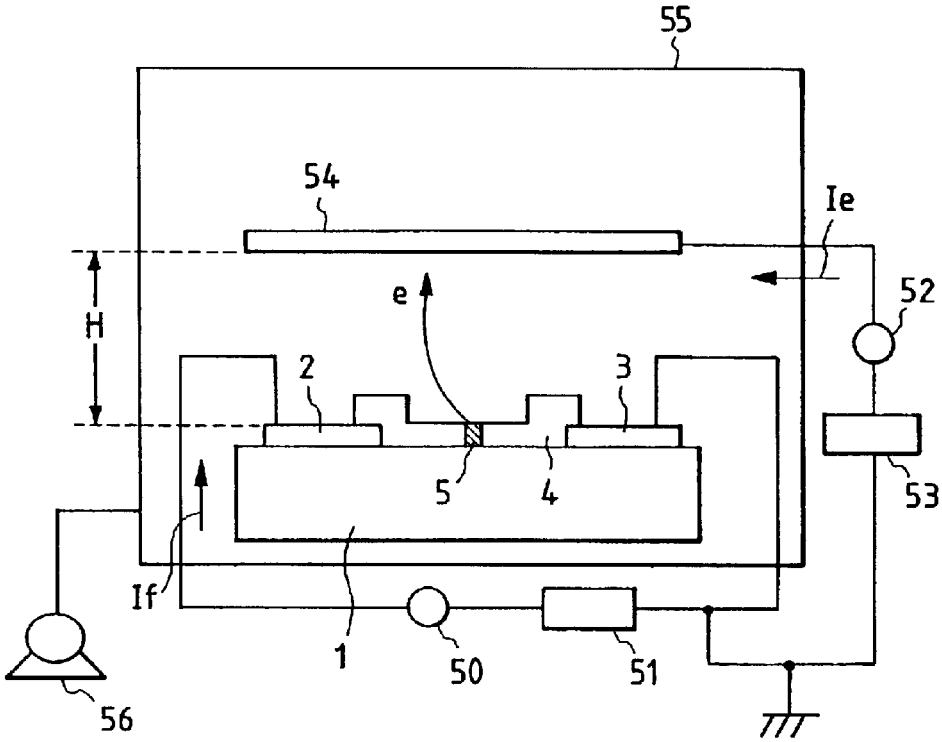
FIG. 5 is a schematic block drawing of a measuring/evaluation device for measuring electron-emitting properties, wherein (e) represents an emitted electron.

FIG. 5 is a schematic block drawing of a measuring/evaluation device for measuring electron-emitting properties of the electron-emitting device illustrated in FIGS. 1A and 1B. In this FIG. 5, the reference numerals which are the same as the reference numerals in FIGS. 1A and 1B illustrate the same items as in FIGS. 1A and 1B. Reference numeral 51 denotes a power source to apply device voltage Vf to the electron-emitting device, reference numeral 50 denotes an ammeter for measuring the device current If flowing through the electroconductive film 4 between the device electrodes 2 and 3, reference numeral 54 denotes an anode electrode for capturing the emission current Ie which is emitted from the electron-emitting region of the electron-emitting device, reference numeral 53 denotes a high-voltage power source for applying voltage to the anode electrode 54, reference numeral 52 denotes an ammeter for measuring the emission current Ie emitted from the electron-emitting region 5 of the device, reference numeral 55 denotes a vacuum apparatus, and reference numeral 56 denotes an exhaust pump.

Further, the electron-emitting device, the anode electrode 54, etc., are situated within the vacuum apparatus 55. Underneath the vacuum apparatus 55 is provided the equipment necessary for the vacuum apparatus such as an unshown vacuum meter, and is configured so that measuring and evaluation of the electron-emitting device can be conducted under any desired vacuum. The exhaust pump 56 is comprised of a standard high-vacuum apparatus system comprised of a turbo pump and rotary pump, and an ultra-vacuum apparatus system comprised of an ion pump, etc. Further, the entire vacuum apparatus and the electron-emitting device can be heated up to 300° C. by means of a heater (not shown). Consequently, processes following the aforementioned energization forming process can be conducted with this measuring/evaluation apparatus, as well.

As one example, measurement was made with the anode electrode voltage within the range of 1 kV to 10 kV, and the distance between the anode electrode and the electron-emitting device within the range of 2 mm to 8 mm.

Figure 6:
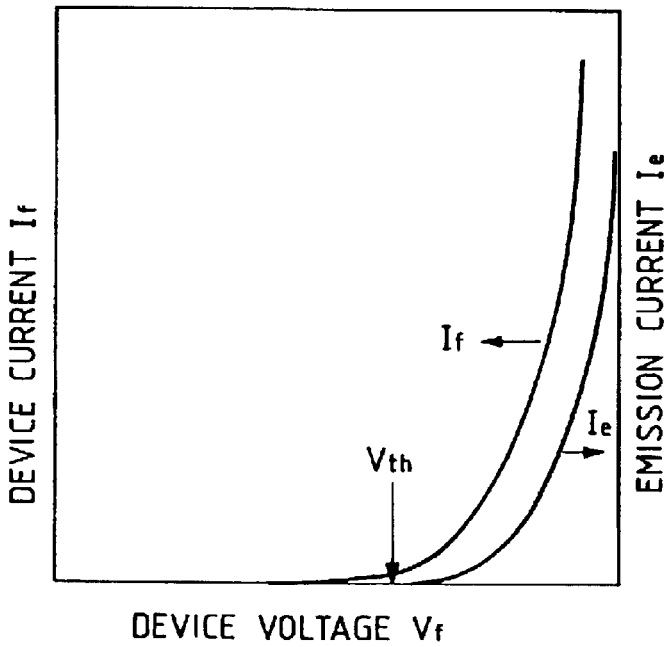
FIG. 6 is a graph illustrating the emission current Ie of the electron-emitting device fabricated according to the manufacturing method of the present invention, and a typical example of the relation of device current If and device voltage Vf.

FIG. 6 illustrates a typical example of the relation of emission current Ie and device voltage Vf as measured with the measuring/evaluation apparatus shown in FIG. 5. FIG. 6 uses arbitrary units, as the emission current Ie is markedly smaller than the device voltage If.

As can be clearly seen from FIG. 6, the electron-emitting device manufactured according to the method of the present invention has three characteristic properties regarding the emission current Ie.

First, when device voltage of a certain voltage (referred to as "threshold voltage", and denoted in FIG. 6 as Vth) is applied to the aforementioned electricity-emitting device, the emission current Ie suddenly increases, and on the other hand, there is practically no emission current Ie detected when the applied voltage is smaller than the threshold voltage; i.e., the aforementioned electricity-emitting device is a non-linear type device with a clear threshold voltage Vth regarding the emission current Ie.

Second, the emission current Ie is dependent on the device voltage Vf in a monotone increase manner, the emission voltage Ie can be controlled by means of the device voltage Vf.

Third, the emission current captured by the anode electrode is dependent on the time of applying the device voltage Vf; i.e., the electric charge captured by the anode electrode 54 can be controlled by means of the time of applying the device voltage Vf.

Since the electron-emitting device manufactured according to the manufacturing method of the present invention has such properties, the electron-emitting properties thereof can be easily controlled by means of input signals, even in electron sources of arrayed multiple electron-emitting devices, and such image forming apparatuses, enabling application to many areas.

Further, while an example of the preferable property of monotone increase (referred to as MI properties) of the device current If relating to device voltage Vf was illustrated in FIG. 6 with a solid line, there are other properties which sometimes are exhibited; i.e., the device current If exhibiting voltage control negative resistance (referred to as VCNR) relating to device voltage Vf (not shown in FIG. 6). Furthermore, these properties of the device current are dependent on the manufacturing method and the measurement conditions when measuring, etc. In this case as well, the electron-emitting device maintains the three aforementioned properties.

Next, description will be given regarding the manufacturing method of the electron source of the present invention, and regarding the electron source to be manufactured according to this method.

The manufacturing method of the electron source according to the present invention is a manufacturing method of an electron source comprising an electron emitting device and voltage application means to the aforementioned device, and is a method wherein the aforementioned electron-emitting device is fabricated according to the aforementioned manufacturing method of the electron-emitting device of the present invention. With the manufacturing method of the electron source of the present invention, there are no limitations except that the electron-emitting device be manufactured according to the manufacturing method of the electron-emitting device of the present invention, and there are no particular limitations on the specific construction of voltage application means of the electron source manufactured by this method.

The following is a description of the manufacturing method of the electron source of the present invention, and a preferable form of an electron source manufactured by that method.

Examples of arraying electron-emitting devices upon a substrate include the following: e.g., arraying a great number of electron-emitting devices in a parallel manner as described in the example of known art, arraying a great number of rows (referred to as "row direction") of electron-emitting devices each having both edges thereof connected with wiring, and controlling the electrons emitted from the electron-emitting devices by means of control electrodes (also referred to as a "grid") located in the space above the electron-emitting devices in the direction perpendicular to the aforementioned wiring (referred to as "column direction"), thereby forming a ladder-like array; and the later-mentioned example of providing an n number of Y-directional wires upon an m number of X-directional wires via an inter-layer insulation layer, and forming an array by connecting each pair of device electrodes of electron-emitting devices with respective X-directional wiring and Y-directional wiring. The latter array is referred to a simple matrix. First, detailed description of the simple matrix array will be given.

According to the three basic properties of the electron-emitting device fabricated according to the manufacturing method of the present invention, the electrons emitted from the aforementioned device are controlled by means of crest value and width of the pulse voltage applied between the opposing device electrodes when the voltage is at the threshold voltage or greater, even regarding electron-emitting devices arrayed in a simple matrix. On the other hand, voltage is lower than the threshold voltage, there are practically no emission electrons emitted. According to this property, if the aforementioned pulse voltage is applied to each of the devices appropriately, the electron-emitting device can be selected according to the input signal, thereby enabling control of the electron emission amount, even when there are many electron-emitting devices arrayed.

Figure 7:
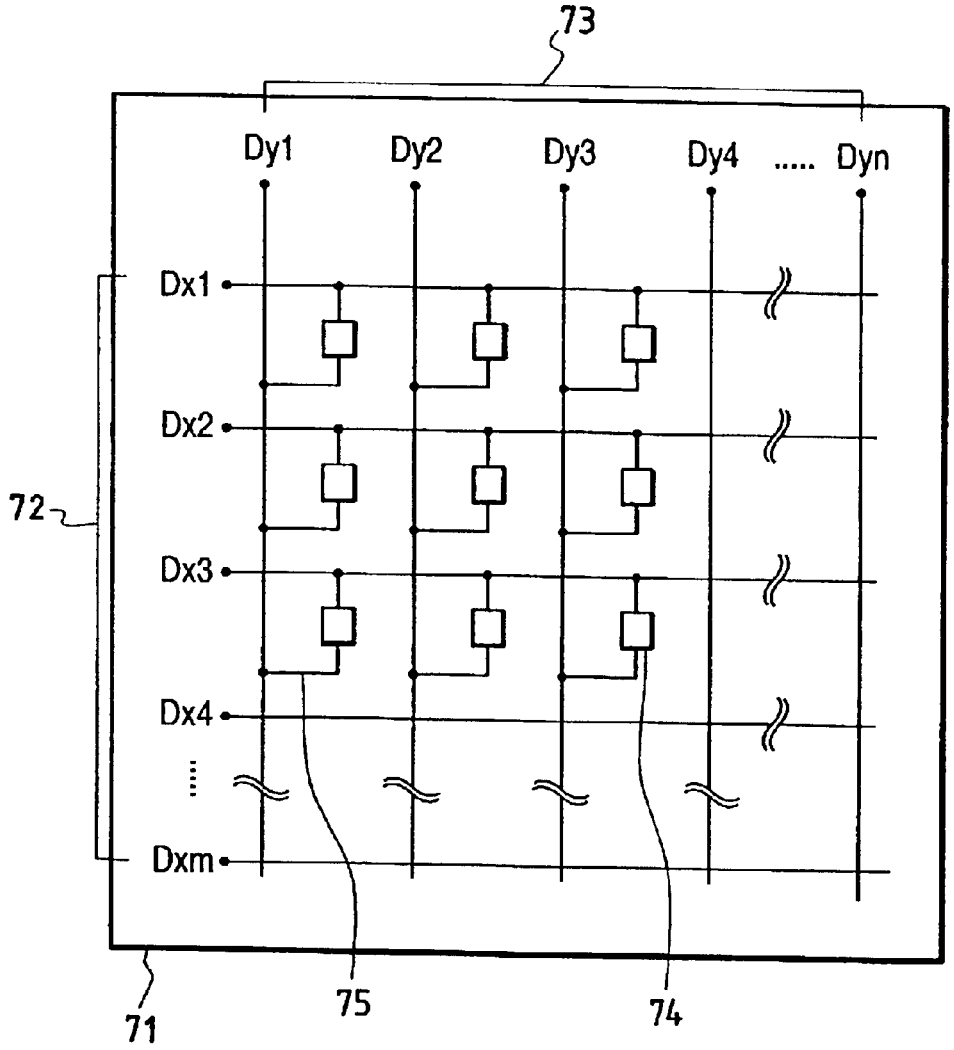
FIG. 7 is a schematic block drawing of an electron source of a simple matrix array used preferably with the present invention.

The following is a description of the construction of an electron source manufactured based on this principle, with reference to FIG. 7. Reference numeral 71 denotes an electron source substrate, reference numeral 72 denotes X-directional wiring, reference numeral 73 denotes Y-directional wiring, reference numeral 74 denotes an electron-emitting device, and reference numeral 75 denotes a connecting wire. The electron-emitting device 74 may be anything so long as it has been manufactured according to the aforementioned manufacturing method of the present invention, and may be either of the aforementioned flat-type or step-type.

In FIG. 7, the electron source substrate 71 is a glass substrate, etc., as described above, and the number of electron-emitting devices to be arrayed thereupon and the design of each of the devices are set as appropriate according to the usage thereof.

The X-directional wiring 72 is comprised of an m number (m being a positive integer) of wires as in Dx1, Dx2, . . ., Dxm; and is of a conductive metal etc., formed upon the electron source substrate by means of vacuum evaporation, printing, sputtering, etc. The material, film thickness, and wire width thereof are appropriately set so as to allow for approximately uniform supplying of voltage to the great number of electron-emitting devices. The Y-directional wiring 73 is comprised of an n number (n being a positive integer) of wires as in Dy1, Dy2, . . ., Dyn; and is constructed in the same manner as the X-directional wiring 72. An unshown inter-layer insulation layer is formed between the m number of X-directional wires 72 and the n number of Y-directional wires 73, thereby achieving electrical separation and constructing matrix wiring.

The unshown inter-layer insulation layer is of $SiO_2$, etc., formed by vacuum evaporation, printing, sputtering, etc., and is formed in a desired shape upon either all or part of the substrate 71 upon which is formed the X-directional wiring 72, with the film thickness, material, and manufacturing method thereof being selected appropriately so as to be able to withstand the electric potential difference at the intersection point of the X-directional wiring 72 and the Y-directional wiring 73. Further, the X-directional wiring 72 and the Y-directional wiring 73 are extended from the substrate as external terminals.

Further, the device electrodes (not shown) situated opposing the electron-emitting devices 74 are each electrically connected with the m number of X-directional wires 72 and n number of Y-directional wires 73 by means of connecting wires 75 comprised of conductive metal, etc., formed by means of vacuum evaporation, printing, sputtering, etc.

Now, the conductive metal of the m number of X-directional wires 72, the n number of Y-directional wires 73, the connecting wires 75, and the opposing electrodes may be partially or totally identical regarding the constituent elements thereof, or may be all different, the materials thereof be selected from the aforementioned device electrode materials appropriately. Further in the event that the wiring to these device electrodes is comprised of the same wiring material as that of the device electrodes, this wiring may be collectively referred to as "device electrodes". The electron-emitting devices may be formed upon either the substrate 71 or upon the inter-layer insulation layer (not shown).

Further, in a latter-described construction, an unshown scanning signal generating means for applying scanning signals is electrically connected to the aforementioned X-directional wiring 72 in order to conduct scanning of rows of emitting devices 74 arrayed in the X-direction according to input signals. On the other hand, an unshown modulation signal generating means for applying modulation signals is electrically connected to the Y-directional wiring 73 in order to conduct modulation of columns of emitting devices 74 arrayed in the Y-direction according to input signals. Moreover, further the drive voltage applied to each device of the electron-emitting devices is provided as the difference voltage between the scanning signals and modulation signals applied to the aforementioned devices.

With the above construction, it becomes possible to select and drive individual devices by means of only a simple matrix wiring.

Next, description will be given regarding the manufacturing method of a display panel according to the present invention, and the display panel manufactured by means of this method.

The manufacturing method of the display panel according to the present invention is a method of a display panel comprised of: a power source comprised of electron-emitting devices and voltage application means for applying voltage to the aforementioned devices; and a fluorescent screen which exhibits luminous emission by receiving electrons emitted from the aforementioned devices. This manufacturing method is characterized by the manufacturing of the aforementioned electron-emitting devices being conducted according to the aforementioned method of manufacturing electron-emitting devices according to the present invention. Regarding the manufacturing method of the display panel of the present invention, there are no limitations except that the manufacturing of the aforementioned electron-emitting devices be conducted according to the aforementioned method of manufacturing electron-emitting devices according to the present invention, and there are no specific limitations regarding the construction of the electron source or fluorescent film of the display panel manufacture by this method.

Figure 8:
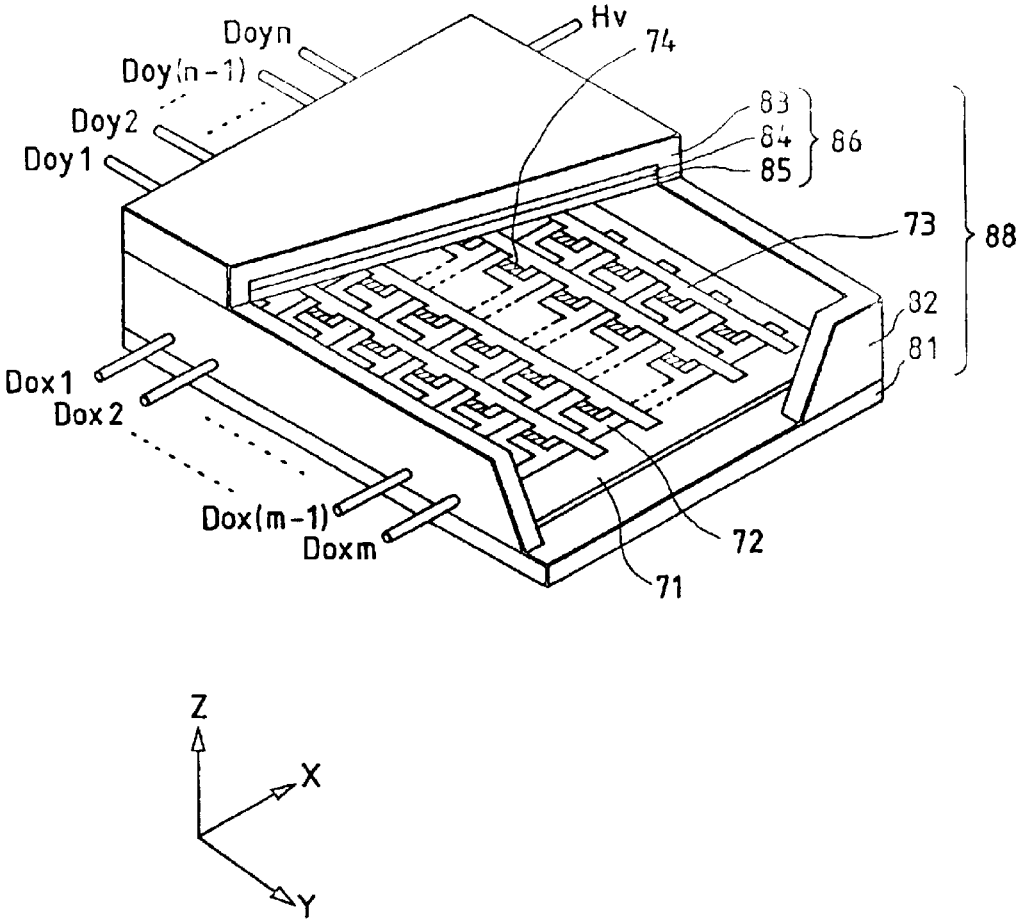
FIG. 8, is a schematic block drawing of a display panel used preferably with the present invention, the display panel using an electron source of a simple matrix array.
Figure 9A:
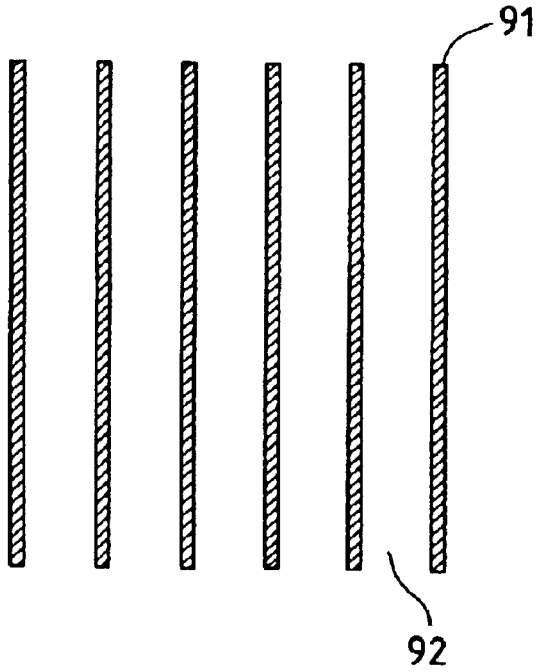
FIGS. 9A and 9B are pattern drawings illustrating an example of a fluorescent screen.
Figure 9B:
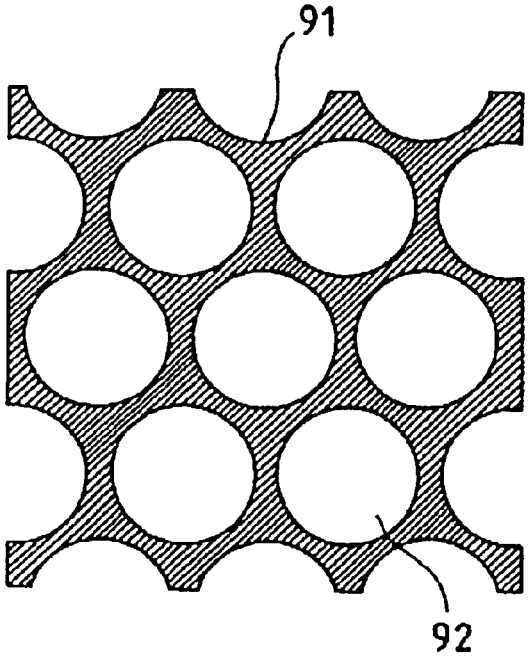

The following is a description of a display panel for displaying, etc., manufactured using the simple matrix array electron source manufactured as described above, as a preferable form of the manufacturing method of the display panel according to the present invention and a display panel manufactured according to that method, with reference to FIGS. 8, 9A and 9B. FIG. 8 is a basic block drawing of the display panel, and FIGS. 9A and 9B are pattern drawings illustrating an example of a fluorescent screen.

In FIG. 8, reference numeral 71 denotes an electron source substrate upon which electron-emitting devices have been arrayed as described above, reference numeral 81 denotes a rear plate to which the electron-emitting devices are fixed, reference numeral 86 denotes a face plate comprised of a fluorescent screen 84 and a metal back 85 formed on the inner side of the glass substrate 83, and reference numeral 82 denotes a frame, wherein the rear plate 81, the frame 82 and the face plate 86 are coated with such as frit glass and then baked at 400° C. to 500° C. for 10 minutes or more in an ambient atmosphere or a nitrogen atmosphere, thereby sealing the assembly and constructing the envelope 88.

In FIG. 8, reference numeral 74 corresponds to the electron emitting region in FIGS. 1A and 1B. Reference numerals 72 and 73 receptively denote the X-directional wiring and Y-directional wiring which is connected to one pair of device electrodes of an electron-emitting device.

While the envelope 88 is, as described above, comprised of a face plate 86, a frame 82, and a rear plate 81, the rear plate 81 is provided mainly for supplementing the strength of the substrate 71; therefore, in the event that the strength of the substrate 71 is sufficient by itself a separate rear plate 81 is unnecessary, so that the construction can be made to be such wherein the frame 82 is directly sealed to the substrate 71, and the envelope 88 is constructed of the face plate 86, the frame 82, and the substrate 71. Or, further, an envelope 88 constructed with sufficient strength against the atmospheric pressure may be constructed by means of providing an unshown support member referred to as a "spacer" between the face plate 86 and the rear plate 81.

FIGS. 9A and 9B illustrate a fluorescent screen. The fluorescent screen 84 is comprised of fluorescent substance alone in the event that the fluorescent screen is to be used for monochrome only, but in the event that the fluorescent screen is to be used for color, the fluorescent screen is comprised of black conductive material 91 which is called black striping or black matrix, depending on the array of the fluorescent substance, and the fluorescent substance 92. The object for providing the black striping or black matrix is to hide mixing of colors by means of blackening the coloring border portion between each of the fluorescent substances 92 of the trichromatic fluorescent substances necessary to conduct color display, and also to control degradation of contrast due to reflection of external light on the fluorescent film 84. As for material for the black striping, commonly employed material with black lead as the primary ingredient may be used, but is not limited to such, as any material may be used so long as the material possesses electrical conductivity and there is little transmission or reflectance of light.

The methods used for coating the glass substrate 83 with fluorescent substance are deposition or printing, regardless of whether monochrome or color.

Further, a metal back 85 is normally provided at the inner side of the fluorescent film 84. The objects of the metal back are such as follows: to increase brightness by means of reflecting light emitted from the fluorescent substance toward the inner side so that the reflected light is directed toward the face plate 86; to be used as an electrode for applying the electron beam accelerating voltage; to protect the fluorescent film from damage due to collision of negative ions generated in the envelope; etc. The metal back can be manufactured following manufacturing of the fluorescent film by means of a graduation process (generally referred to as "filming") of the inner surface of the fluorescent film, following which deposition is conducted by means of deposition of A1 employing vacuum evaporation, etc.

Regarding the face plate 86, a transparent electrode (not shown) may be provided to the outer side of the fluorescent film 84 in order to further increase the conductivity of the fluorescent film 84.

Upon conducting sealing, sufficient positioning must be conducted, as each of the fluorescent substances must be corresponded with the electron-emitting devices in the case of color.

The envelope 88 is drawn to a vacuum of around $10^{-7}$ Torr by means of the exhaust tube (unshown), and is sealed. Further, getter processing may be conducted in order to maintain the vacuum of the envelope 88 following sealing. This is conducted by heating a getter positioned at a predetermined position (unshown) within the envelope 88, employing a heating method such as resistance heating or high-frequency heating, thereby forming a vacuum evaporation film, the above process being conducted either prior to conducting sealing or following sealing. The main ingredient of the getter is generally Ba, and maintains a high degree of vacuum due to the adsorption action of the aforementioned vacuum evaporation film. Moreover, the processes regarding the electron-emitting device following forming are determined as appropriate.

The manufacturing method of the image-forming apparatus according to the present invention is a method of manufacturing an image-forming apparatus comprised of: a power source comprised of electron-emitting devices and voltage application means for applying voltage to the aforementioned devices; a fluorescent screen which exhibits luminous emission by receiving electrons emitted from the aforementioned devices; and a drive circuit which controls the voltage applied to the aforementioned devices based on external signals. This manufacturing method is characterized by the manufacturing of the aforementioned electron-emitting devices being conducted according to the aforementioned method of manufacturing electron-emitting devices according to the present invention. Regarding the manufacturing method of the image-forming apparatus of the present invention, there are no limitations except that the manufacturing of the aforementioned electron-emitting devices be conducted according to the aforementioned method of manufacturing electron-emitting devices according to the present invention, and there are no specific limitations regarding the construction of the electron source, fluorescent film, or drive circuit of the image-forming apparatus manufactured by this method.

Figure 10:
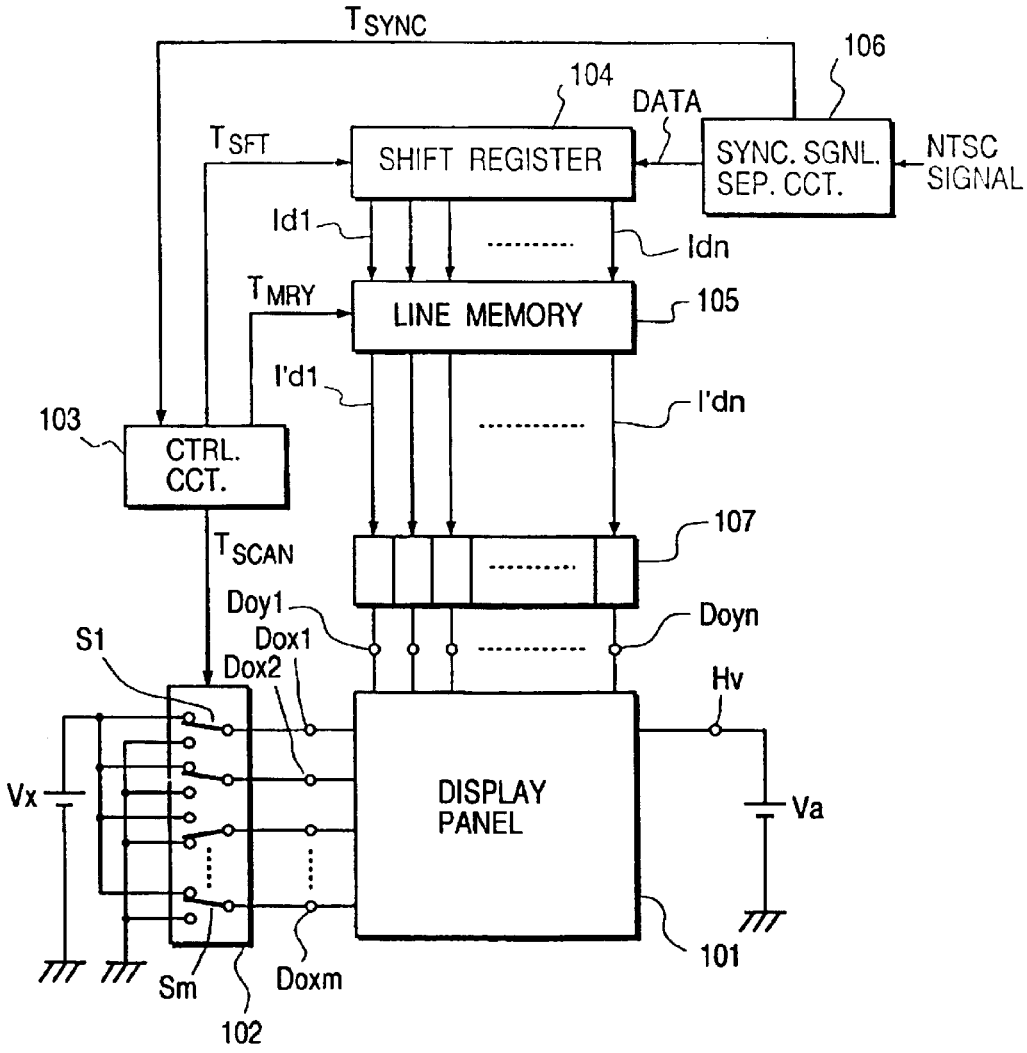
FIG. 10 is a block drawing of the drive circuit of an example wherein an image-forming apparatus used preferably with the present invention is applied to NTSC television signals.

The following is a description of an image-forming apparatus conducting television display based on NTSC television signals by means of employing a display panel manufactured using a simple matrix array electron source, as a preferable form of the manufacturing method of the image-forming apparatus according to the present invention and an image forming apparatus manufactured according to that method, with reference to FIG. 10 for the schematic construction thereof. FIG. 10 is a block drawing of the drive circuit of an example wherein an image-forming apparatus conducts display according to NTSC television signals. In FIG. 10, reference numeral 101 denotes the aforementioned display panel, reference numeral 102 denotes a scanning circuit, reference numeral 103 denotes a control circuit, reference numeral 104 denotes a shift register, reference numeral 105 denotes line memory, reference numeral 106 denotes a synchronizing signal distributing circuit, reference numeral 107 denotes a modulation signal generator, and Vx and Va are direct current electrical power sources.

The following is an description of the functions of each of the parts. First, the display panel 101 is connected with an external electric circuit via terminal Dox1 through Doxm, and terminal Doy1 through Doyn, and high voltage terminal Hv. Of these, scanning signals are applied to the terminal Dox1 through Doxm in order to sequentially drive the electron source provided within the aforementioned display panel; i.e., the group of electron-emitting devices arrayed by matrix wiring in rows and columns of M rows and N columns, one line at a time (N devices). On the other hand, to the terminal Doy1 through Doyn is applied signals for controlling the output electron beam of each of the devices of the row of electron-emitting devices selected by the aforementioned scanning signal. Also, direct current voltage of 10K [V] for example is applied to the high-voltage terminal Hv by means of the direct current electrical source Va, this voltage being an accelerating voltage for providing sufficient energy to the electron beams output from the electron-emitting device to cause excitation of the fluorescent substance.

Next, description will be given regarding the scanning circuit 102. This circuit contains an M number of switching devices therein (represented in the Figure by S1 through Sm), the switching devices being such that either the output voltage of the direct current source Vx or 0 [V] (ground level) is selected, thereby making electrical connection with terminal Dox1 through Doxm of the display panel 101. The switching devices of S1 through Sm operate based on control signals Tscan output from the control circuit 103, but a more simple construction thereof is possible by combining with switching devices such as FET, for example.

With the present embodiment, the aforementioned direct current power source Vx is set so as to output a constant voltage so that the drive voltage applied to the unscanned devices is the same as the electron emission threshold or lower, based on the properties (electron emission threshold voltage) of the aforementioned electron-emitting device.

Further, the control circuit 103 works so as to interface the actions of each of the parts so that appropriate display can be conducted based on image signals input externally. The control signals Tscan, Tsft, and Tmry are generated based on the synchronizing signal Tsync sent from the synchronizing signal distributing circuit 106 described next.

The synchronizing signal distributing circuit 106 is a circuit for separating synchronizing signal components and brightness signal components from NTSC television signals, and as is well known, can be easily constructed by using a frequency separation (filter) circuit. The synchronizing signals which are separated by the synchronizing signal distributing circuit 106 are comprised of vertical synchronizing signals and horizontal synchronizing signals, as is well known, but these are shown in the Figure as Tsync signals, for the convenience of making explanation. On the other hand, the image brightness signal component which is separated from the aforementioned television signals is represented in the Figure as DATA for the convenience of making explanation, but this signal is input to the shift register 104.

The shift register 104 is for serial/parallel conversion per image line of the aforementioned DATA signals input serially according to time series, and operates based on control signals Tsft sent from the aforementioned control circuit 103 (it can be said that the control signal Tsft is the shift clock of the shift register 104). The data of one image line which has been subjected to the serial/parallel conversion (equivalent to N electron-emitting devices worth of drive data) is output from the aforementioned shift register 104 as N pieces of Id1 through Idn parallel signal.

The line memory 105 is for storing the data for one line for only as long as needed, and appropriately stores the contents of Id1 through Idn according to the control signals Tmry sent from the control circuit 103. The stored contents are output as I'd1 through I'dn, and are input to the modulation signal generator 107.

The modulation signal generator 107 is a signal source for appropriately conducting driving modulation of each of the electron-emitting devices, according to each of the aforementioned image data I'd1 through I'dn, and the output signal thereof is applied to the electron-emitting devices within the display panel 101, via terminals Doy1 through Doyn.

As mentioned above, the electron-emitting devices of the present invention posses the following properties regarding the emission current Ie; i.e., as mentioned above, there is a clear threshold voltage Vth for electron emission, with electron emission occurring only when voltage of Vth or greater is applied.

Also, regarding voltage above the electron emission threshold, the emission current changes according to change in the voltage applied to the devices. Further, the electron emission threshold value Vth or the degree of change of the emission current relating to the applied voltage may change by differing the material composition of the electron-emitting device or the manufacturing method thereof; regardless, the following can be said.

When applying pulse voltage to the devices, there is no electron emission in the event that a voltage at the electron emission threshold value or lower is applied, but there is output of an electron beam in the event that a voltage at the electron emission threshold value or higher is applied. With regard to this, first, it is possible to control the intensity of the output electron beam by means of changing the pulse crest value Vm. Secondly, it is possible to control the total electrical charge of the output electron beam by means of changing the pulse width Pw.

Consequently, voltage modulation method and pulse-width modulation method can be given as methods of modulation of the electron-emitting devices. In order to conduct voltage modulation, a voltage modulating type circuit which generates a voltage pulse of a constant length but modulates the pulse crest value in appropriate manner according to the input data is used for the modulation signal generator 107. Further, in order to conduct pulse width modulation, a pulse width modulating type circuit which generates a voltage pulse of a constant crest value but modulates the pulse width in an appropriate manner according to the input data is used for the modulation signal generator 107.

In accordance with the above-described series of operations, television display can be conducted using the display panel 101. Although not particularly mentioned in the above description, the shift register 104 and the line memory 105 may be either digital signal type or analog signal type, so long as image signal serial/parallel conversion and storage can be conducted at the predetermined speed.

When employing a digital signal system, there is the necessity to convert the output signal DATA of the synchronizing signal distributing circuit 106 into digital signal form, but it goes without saying that this can be done by providing the output portion of 106 with an A/D converter. Further, it goes without saying that accordingly, the circuit employed for the modulation signal generator 107 differs more or less depending on whether the output signal of the line memory 105 is a digital signal or an analog signal; i.e., in the case of digital signals, if the voltage modulation method is employed, a well-known D/A conversion circuit can be used for the modulation signal generator 107, for example, and amplification circuitry can be added as necessary. If the pulse width modulation method is used, anyone in the present trade can easily construct a modulation signal generator 107 by means of using a circuit comprised of a counter which counts the waves output by a high-speed oscillator and an oscillator, and a comparator which compares the output value of the counter with the output value of the aforementioned memory. An amplifier may be provided as necessary in order to raise the voltage of the modulated signals subjected to pulse width modulation, which are output from the comparator, so that the voltage thereof is raised to the drive voltage of the electron-emitting devices.

On the other hand, in the case of analog signals, if the voltage modulation method is employed, an amplification circuit using a well-known operating amplifier may be used for the modulation signal generator 107, with a level shift circuit being added as necessary. If the pulse width modulation method is used, a well-known voltage control type oscillator circuit (VCO) may be used, and an amplifier may be provided as necessary in order to raise the voltage to the drive voltage of the electron-emitting devices.

According to the image display apparatus used preferably with the present invention thus completed, electron emission is caused by means of applying voltage to each of the electron-emitting devices via external terminals Dox1 through Doxm, and Doy1 through Doyn, and the electron beam is accelerated by means of applying high voltage to the metal back 85 or transparent electrode (not shown), thereby causing the electron beam to collide with the fluorescent film 84 so as to excite the fluorescent film which causes luminous emission, consequently displaying an image.

The aforementioned construction is a schematic construction necessary for fabricating a preferable image-forming apparatus used for displaying, etc.; the materials, etc., of the parts, for example, and the details are not limited to the aforementioned description, but are selected as appropriate according to the purpose of the image-forming apparatus. Further, while NTSC signals were given as an example of input signals, systems such as PAL or SECAM work, and moreover, TV signals comprised of a greater number of scanning lines (e.g., high-definition TV such as MUSE) work as well.

Next, description of an example of the electron source according to the aforementioned ladder-like array, and the display panel and image-forming apparatus thereof will be given with reference to FIGS. 11 and 12.

Figure 11:
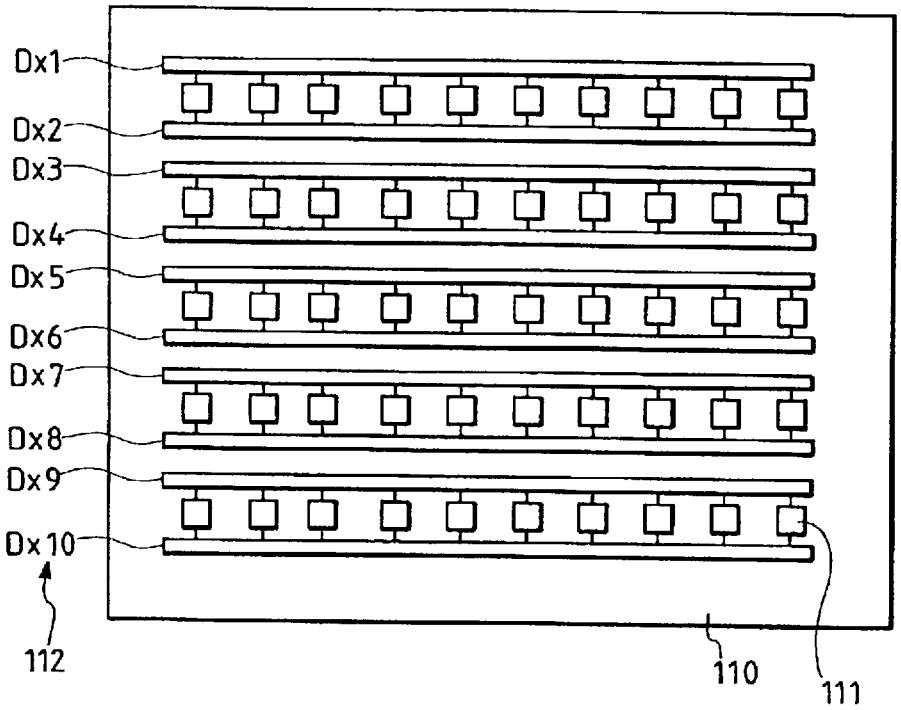
FIG. 11 is a schematic block drawing of an electron source with a lattice array used preferably with the present invention.

In FIG. 11, reference numeral 110 denotes an electron source substrate, reference numeral 111 denotes electron-emitting devices, and reference numeral 112 denotes the common wiring Dx1 through Dx10 for wiring the aforementioned electron-emitting devices. A plurality of electron-emitting devices 111 are arrayed upon the electron source substrate 110 in a parallel matter in the X-direction (this is referred to as "device row"). A plurality of these device rows are arrayed so as to form an electron source. Each of the devices can be independently driven by means of applying appropriate drive voltage between the common wiring of each of the device rows; i.e., this can be achieved by applying voltage which is at the electron emission threshold or greater to the device rows from which emission of electron beam is desired, and applying voltage which is at the electron emission threshold or lower to the device rows from which emission of electron beam is not desired. Also, the common wiring Dx2 through Dx9 may be configured so as to have, for example, Dx2 and Dx3 as a single wire.

Figure 12:
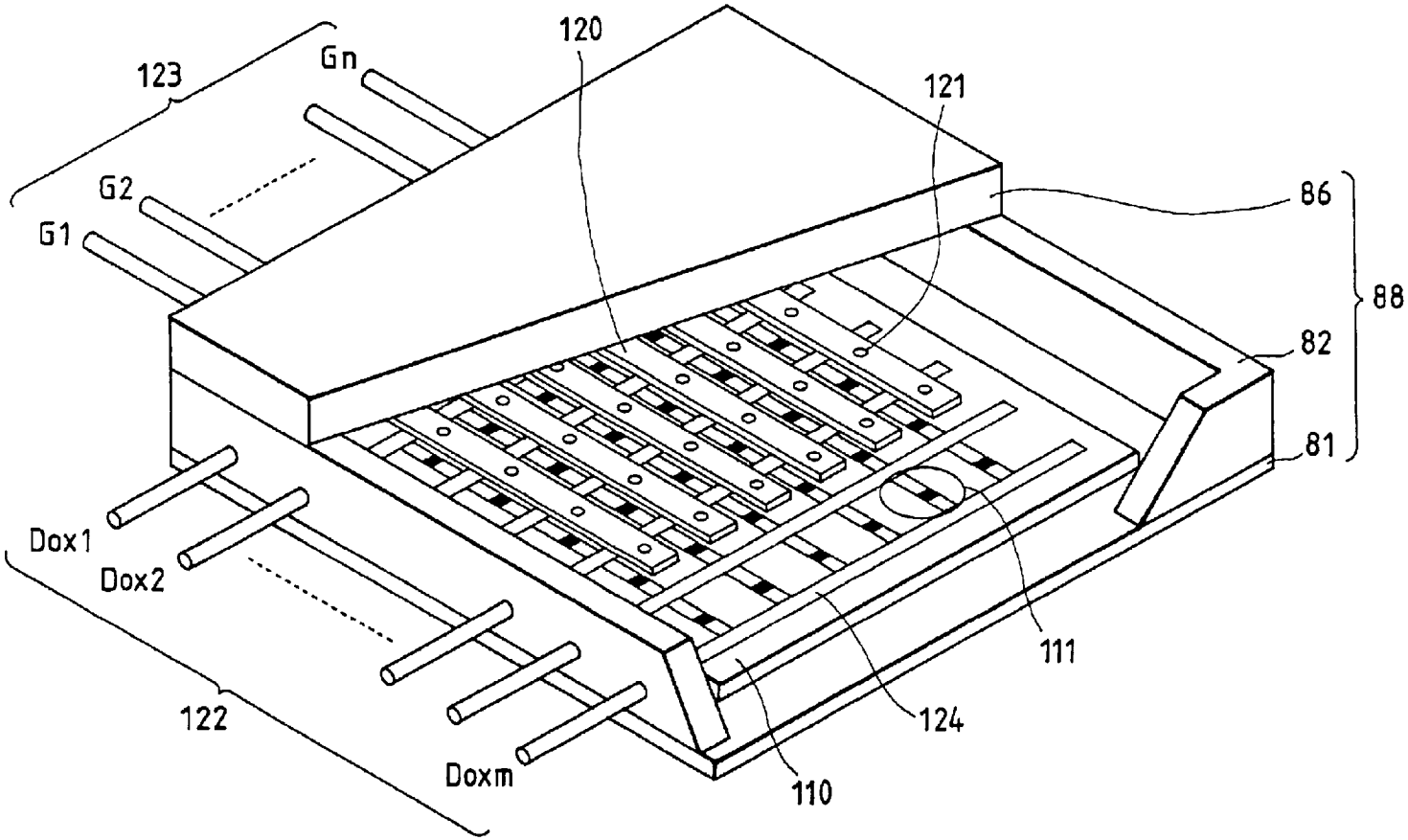
FIG. 12 is a schematic block drawing of a display panel used preferably with the present invention with a lattice array.

FIG. 12 illustrates a display panel of an image-forming apparatus provided with an electron source according to the aforementioned ladder-like array. Reference numeral 120 denotes grid electrodes, reference numeral 121 denotes apertures through which electrons are to pass, reference numeral 122 denotes external terminals comprised of Dox1, Dox2 . . . Doxm, reference numeral 123 denotes external terminals comprised of G1, G2 . . . Gn connected to grid electrodes 120, and reference numeral 124 denotes an electron source substrate where the common wiring between each of the devices has been made to be singular wiring, as described above. Further, in FIG. 12, the reference numerals which are the same as those in FIGS. 8 and 11 indicate members which are the same as those in these Figures. A major difference between this configuration and the aforementioned simple matrix array image-forming apparatus (shown in FIG. 8) is that grid electrodes 120 are provided between the electron source substrate 110 and the face plate 86.

Grid electrodes 120 are provided between the electron source substrate 110 and the face plate 86. The grid electrodes 120 are capable of modulating the electron beams emitted from the electron-emitting devices, with one circular aperture 121 being provided for each device, in order to allow passage of electron beams through the stripe-formed electrodes provided in an intersecting manner with the device rows of the ladder-like array. The form or the position of provision of the grid need not be like that illustrated in FIG. 12, many passageways may be provided in a mesh-like matter for apertures, or, for example, such may be provided in the periphery of the electron-emitting devices or nearby.

The external terminals 122 and the grid external terminals 123 are electrically connected with an unshown control circuit.

With the aforementioned image-forming apparatus, the irradiation of each of the electron beams to the fluorescent substances is controlled by means of synchronously and simultaneously applying one line worth of modulation signals to a grid electrode row while sequentially driving (scanning) device rows one column at a time.

Further, according to the present invention, an image-forming apparatus is provided which is used as a preferable display apparatus not only for television broadcasting, but also for display apparatuses for television conferencing systems, computers, etc. Further, it is possible to use as an image-forming apparatus of a photo-printer which is constructed by making a combination with a photosensitive drum, etc. In this case, application can be made to not only a line-form emission source, but to a two-dimensional emission source, by means of appropriately selecting the aforementioned m number of row direction wires and n number of column direction wires.

The following are embodiments of the present invention.

Embodiment 1

And electron-emitting device of the type illustrated in FIGS. 1A and 1B was manufactured as an electron-emitting device. FIG. 1A is a plan view illustrating the construction of the present electron-emitting device, and FIG. 1B is a cross-sectional view thereof. In FIGS. 1A and 1B, reference numeral 1 denotes an insulating substrate, reference numerals 2 and 3 denote a pair of device electrodes, reference numeral 4 denotes a film including an electron-emitting region, and reference numeral 5 denotes an electron-emitting region. In the Figures, L represents the spacing between the device electrode 2 and the device electrode 3, W represents the length of the device electrodes, d represents the thickness of the device electrodes, and W' represents the width of the device.

The manufacturing method of the electron-emitting device of the present invention will now be described with reference to FIGS. 19A through 19D. A quartz glass plate was used as the insulating substrate 1, and following through washing of this plate by means of organic solvent, Au device electrodes 2 and 3 were formed upon the substrate by means of screen printing (FIG. 19A). The device electrode spacing L was set at 30 microns, the device electrode width W was set at 500 microns, and the thickness thereof was set at 1000 angstrom.

Methyl cellulose was added to water, and the viscosity of the solution was adjusted to be 5 centipoise in viscosity, which was then deposited onto part of the electrodes 2 and 3 by means of a bubble-jet type ink-jet apparatus (FIG. 19B), then heated at 150° C. for 15 minutes. The substrate was then cooled to room temperature again.

An aqueous solution 40% by weight of dimethylsulphoxide was prepared, and palladium acetate was added thereto so that the palladium would be 0.4% by weight, thereby obtaining a dark red-colored solution. Part of this solution was taken to a separate container and the solvent was evaporated so as to result in a red-brown colored paste.

The aforementioned dark red-colored solution was deposited by means of a bubble-jet type ink-jet apparatus onto the quartz plate on which the electrodes 2 and 3 had been formed, in such a manner that the solution connected the electrodes 2 and 3 upon which it was deposited, and then dried at 80° C. for 2 minutes. Deposition of droplets was conducted regarding multiple devices, and the results thereof was that there was no real penetrating of the deposited droplets into the electrodes, and that droplets could be deposited with good reproducability.

Further, measurements of the film thickness were taken in order to evaluate the reproducability. The term "film thickness" here refers to the maximum thickness of the device in a form such as illustrated in FIG. 19C. The distribution of the film thickness within the device is calculated as follows: e.g., in the event that the electroconductive thin film 4 has been formed in a form approximately circular, a circle is drawn at 90% of the film radius, with the intermediate point between the electroconductive device electrodes being the center of the circle, and the result of subtracting the minimum value of the film thickness from the maximum value is divided by the maximum value. Further, the form of the film can be changed by the composition of the organic metal compound solution, the method of depositing droplets, etc. Even if the form thereof is not circular, the maximum and minimum film thicknesses of the film are evaluated in the same way, the outermost 10% being removed from consideration.

The inter-device film thickness distribution is an evaluation of the aforementioned in-device film thickness distribution between the devices.

Next, an electroconductive film was formed by means of baking for 12 minutes at 350° C. (FIG. 19C). The average film resistance of this electron-emitting region-forming thin film 4 was 100 angstrom, and the sheet resistance thereof was $5\times10^4$ Ω/□.

Figure 19D:
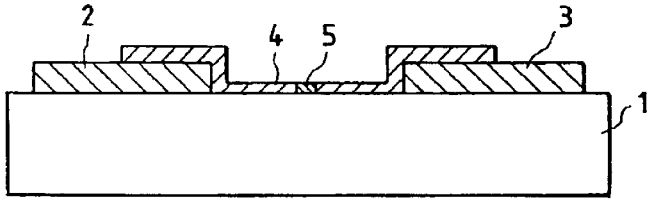

Next, voltage was applied to the device electrodes 2 and 3 within a vacuum container, and the electron-emitting region 5 was formed by means of conducting current conduction treatment (forming treatment) to the electron-emitting region-forming thin film 4 (FIG. 19D). FIG. 4A illustrates the voltage waveform for forming treatment.

With the present embodiment, the pulse width T1 of the voltage waveform was set at 1 millisecond, the pulse interval T2 thereof was set at 10 milliseconds, the crest value of the triangular wave (peak voltage when conducting forming) was set at 5V, and the forming treatment was conducted for 60 seconds under a vacuum atmosphere of approximately $1\times10^{-6}$ torr. Further, acetone at $10^{-3}$ torr was introduced into the vacuum container, pulse voltage the same as with forming was applied for 15 minutes, thereby conducting an activation process.

Having fabricated 100 devices as described above, the average diameter of the fine particles was 50 angstrom for all pieces. The irregularities in the film thickness of the electroconductive film 21 are shown later in Table 1. Further, the electron-emitting properties of each of the devices was measured by means of a measuring/evaluation apparatus of a construction such as illustrated in FIG. 5.

The present electron-emitting device and anode electrode 54 are situated within a vacuum apparatus, the vacuum apparatus being provided with equipment necessary for the vacuum apparatus such as an unshown exhaust pump and vacuum gauge, so that measurement and evaluation of the present electron-emitting device can be conducted at a desired degree of vacuum. With the present embodiment, the distance between the anode electrode and the electron-emitting device was set at 4 mm, the potential of the anode electrode was set at 1 kV, and the degree of vacuum within the vacuum apparatus for when measuring electron emission properties was set at $1\times10^{-6}$ torr.

Using such a measuring/evaluation apparatus, device voltage was applied between the electrodes 2 and 3 of 100 devices of the present electron-emitting device, and the device current If and the emission current Ie flowing at that time were measured, the resultant current-voltage properties being shown in FIG. 6. When the emission current Ie under 12V of device voltage was measured, an average of 0.2 μA was obtained, and an electron-emission efficiency of 0.05% was obtained. The uniformity between the devices was also good, the irregularity of Ie values between the devices being 5%, which is good.

In the embodiment describe above, a triangular pulse is applied between the electrodes to form the electron-emitting region, but the voltage waveform to be applied between the electrodes of the device need not be limited to a triangular form; any waveform, such as rectangular. Further, the crest value, pulse width, and pulse interval, etc., need not be limited to the above values; any values may be selected so long as the electron-emitting region is preferably formed.

Embodiment 2

Polyvinyl alcohol (reffered to PVA) was added to water, and the viscosity of the solution was adjusted to be 5 centipoise in viscosity, which was then deposited onto part of the electrodes by means of a bubble-jet type ink-jet apparatus, then heated at 100° C. for 10 minutes, then cooled to room temperature again. Following this, 100 devices of the present electron-emitting device were fabricated in the same manner as with Embodiment 1. The irregularities in the film thickness of the electroconductive film are shown later in Table 1. Further, when a device voltage was applied between the electrodes 2 and 3 of the present electron-emitting device by means of the measuring/evaluation apparatus described in Embodiment 1, the electron emission under 12V of device voltage was an average of 0.2 μA, and an electron-emission efficiency of 0.05% was obtained. The irregularity of Ie between the devices was 6%.

Embodiment 3

Droplets of the following solutions of aqueous resin solution and organic metal compound solution were deposited as with the Embodiment 2, and electron-emitting devices 3.1 thorough 3.4 were fabricated. Table 1 shows the evaluation results regarding the film thickness and the distribution thereof. The evaluation method was the same as with the Embodiment 1.

Comparative Example 1

A quartz glass substrate was used as the insulating substrate, and following through washing of this substrate by means of organic solvent, Au device electrodes were formed upon the substrate by means of offset printing. The device electrode spacing, width, and thickness thereof was the same as with the device described in Embodiment 1.

An aqueous solution 40% by weight of dimethylsulphoxide was prepared, and palladium acetate was added thereto so that the palladium would be 0.4% by weight, thereby obtaining a dark red-colored solution. Part of this solution was taken to a separate container and the solvent was evaporated so as to result in a red-brown colored paste.

The aforementioned dark red-colored solution was deposited by means of a bubble-jet type ink-jet apparatus onto the quartz plate on which the electrodes had been formed, in such a manner that the solution connected the electrodes upon which it was deposited, and then dried at 80° C. for 2 minutes. Next, an electroconductive film 4 was formed by means of baking for 12 minutes at 350° C. Upon depositing droplets on multiple devices, a phenomena developed where droplets penetrated into the electrodes of some of the devices, and the film thickness of these electrodes following baking was thinner than that of the other devices. The results thereof are shown later in Table 1.

Following this, forming treatment was conducted with the same method as with the Embodiment 1.

100 devices were fabricated in this manner, and the electron-emitting properties of each of the devices was measured by means of the measuring/evaluation apparatus of a construction such as illustrated in FIG. 5. The results thereof was that the electron emission under 12V of device voltage was an average of 0.2 $\mu$A, and an electron-emission efficiency of 0.05% was obtained. The irregularity of Ie between the devices was greater than that of Embodiments 1 through 3.

TABLE 1

| Embodiment | Aqueous resin | Organic metal compound | Film thickness | Film distribution In-device | Film distribution Between devices |
|---|---|---|---|---|---|
| 1 | Methyl-cellulose | Palla-dium acetate | 108 | 24 | 30 |
| 2 | PVA | Palla-dium acetate | 102 | 15 | 20 |
| 3.1 | Poly-ethyl-glycol | Palla-dium acetate | 99 | 21 | 26 |
| 3.2 | Hydroxy-ethyl-cellulose | Palla-dium acetate | 98 | 23 | 27 |
| 3.3 | Amylo-dextrin | Palla-dium acetate | 110 | 21 | 29 |
| 3.3 | White dextrin | Palla-dium acetate | 101 | 22 | 27 |
| 3.4 | Elithro dextrin | Palla-dium acetate | 100 | 23 | 28 |
| Comparative example 1 | none | Palla-dium acetate | 90 | 35 | 45 |

As shown in Table 1, with Embodiments 1 through 3.4, droplets of and aqueous solution of aqueous resin was deposited between the device electrodes and on either part or all of the device electrodes prior to depositing the droplets of a solution of organic metal compound, the results thereof being that the film thickness was 10% to 20% greater than that of the Comparative example 1, indicating that penetrating of the organic metal compound into the device electrodes is inhibited. Further, while not shown in Table 1, the form of the electroconductive film was near to uniform in all of the embodiments. Consequently, it can be assumed that the film thickness within the device and between the devices is inhibited. Incidentally, it can be thought that the reason that the electron emission properties and the film thickness distribution shown in the embodiments do not always agree is due to being improved during formation of the electron-emitting region by means of processes such as forming and activation.

Embodiment 4

As with Embodiment 1, a solution containing methyl cellulose was deposited each of the pairs of electrodes of a substrate upon which was formed 16 rows and 16 columns for 256 device electrodes and matrix-like wiring, which was then heated, re-cooled, subjected to deposition of organic metal compound solution droplets by means of a bubble-jet type ink-jet apparatus, and following baking, forming treatment was conducted, thereby forming an electron source substrate.

To this electron source substrate was connected a rear plate 81, frame 82, and a face plate 86, and vacuum sealed, thereby fabricating an image-forming apparatus according to the conceptual drawing of FIG. 8. A predetermined voltage was applied to each device from terminal Dox1 to Dox16 and terminal Doy1 to Doy16 by means of time-division, and high voltage was applied to the metal back via terminal Hv, thereby enabling display of an arbitrary image pattern.

Embodiment 5

An electroconductive film of the type of electron-emitting device illustrated in FIGS. 1A and 1B was fabricated as the electroconductive film of the present embodiment. The manufacturing method of the electroconductive film of the present embodiment will be described with reference to FIGS. 1A and 1B and FIGS. 3A through 3E. The reference numerals in FIGS. 1A and 1B and FIGS. 3A through 3E are as described above.

(1) A quartz substrate was used as the insulating substrate 1, and following through washing of this substrate by means of organic solvent, Au device electrodes 2 and 3 were formed upon the aforementioned substrate 1 (FIG. 3A). The device electrode spacing L was set at 2 $\mu$m, the device electrode width W was set at 500 $\mu$m, and the thickness d thereof was set at 1000 angstrom (FIG. 3A).

Next, droplets were deposited upon the substrate between electrodes 2 and 3 and to a certain portion upon the electrodes, by means of a piezo-jet method; i.e., a solution of palladium acetate of 2% by weight was employed, and was ejected from the No. 1 glass nozzle 31 of the piezo-jet type ejecting apparatus (FIG. 3B). Following this, formic acid was used as a reducing decomposer, and was ejected from the No. 2 glass nozzle 33 of the piezo-jet type ejecting apparatus (FIG. 3C).

(2) Next, the aforementioned substrate was heated to a low temperature (100° C. or lower), and a thin film composed of fine metal particles and low-temperature volatile substance was generated. Subsequently, the aforementioned substrate was heated in air at 200° C. for 20 minutes to remove the low-temperature volatile substance by volatilization, and further, heated at 300° C. for 10 minutes to form an electroconductive thin film composed of fine metal oxide particles, thereby obtaining electroconductive film 4 (FIG. 3D). Incidentally, description has been made above regarding the thin film composed of fine metal particles and low-temperature volatile substance, as it is inferred that metal and organic components are isolated in the palladium acetate. When the amount of Pd in the formed electroconductive film was measured by means of plasma emission spectrometry, the Pd was 17.0 $\mu g/cm^2$.

Table 2 shows the evaluation results of the film thickness. Evaluation of the film thickness was conducted in the same manner as with the other Embodiments. Incidentally, the irregularity in film thickness indicates irregularities between devices.

Comparative Example 2

500 electron-emitting devices were fabricated in the same manner as with Embodiment 5 except that no decomposer (formic acid) was ejected, with heat treatment (baking) being conducted directly to the palladium acetate (2% by weight solution).

When the amount of palladium in the electroconductive film obtained by the present comparative example was measured by means of plasma emission spectrometry, the Pd was 16.0 $\mu g/cm^2$. The evaluation results of the film thickness are shown later in Table 2.

Embodiment 6

An electroconductive thin film composed of fine metal nitrate particles and low-volatility substance were generated in the same manner as with Embodiment 5 except that nitric acid was used as an acid decomposer, and further, an electroconductive film was obtained by heating in the same manner as with Embodiment 5.

When the amount of Pd in the formed electroconductive film was measured by means of plasma emission spectrometry, the Pd was 17.0 $\mu g/cm^2$. The evaluation results of the film thickness are shown later in Table 2.

Embodiment 7

A thin film composed of fine metal hydroxide particles and low-volatility substance were generated in the same manner as with Embodiment 5 except that a 2% by weight solution of palladium nitrate was used as the electroconductive film forming material and that 1% aqueous ammonia was used as an hydrolytic decomposer, and further, an electroconductive film was obtained by heating treatment in the same manner as with Embodiment 5.

When the amount of Pd in the formed electroconductive film was measured by means of plasma emission spectrometry, the Pd was 16.8 $\mu g/cm^2$. The evaluation results of the film thickness are shown later in Table 2.

Embodiment 8

Metal hydroxides or a thin film composed of fine metal oxide particles and low-volatility substance were generated in the same manner as with Embodiment 5 except that the bubble-jet method was employed instead of the piezo-jet method, and that an aqueous solution of suspended fine particles of porous aluminum oxide was used as a catalytic decomposer, and further, an electroconductive film was obtained by heating treatment in the same manner as with Embodiment 5.

When the amount of Pd in the formed electroconductive film was measured by means of plasma emission spectrometry, the Pd was 16.7 $\mu g/cm^2$. The evaluation results of the film thickness are shown later in Table 2.

Embodiment 9

Electroconductive film forming material and decomposer were deposited upon the substrate 1 in the same manner as with Embodiment 5 except that a 2% by weight aqueous solution of bisoxalatopalladic acid was used as the electroconductive film forming material, and that a 1% by weight aqueous solution of oxalic acid was used as the hydrolytic decomposer, following which a thin film composed of fine metal hydroxide particles and low-volatility substance were generated by reducing decomposition and photodecomposition by means of irradiation from an ultra-violet lamp. Subsequently, an electroconductive film was obtained by heating treatment in the same manner as with Embodiment 1.

When the amount of Pd in the formed electroconductive film was measured by means of plasma emission spectrometry, the Pd was 16.9 $\mu g/cm^2$. The evaluation results of the film thickness are shown later in Table 2.

TABLE 2

| | Pd amount | Film thickness | Irregularity in film thickness |
|---|---|---|---|
| Embodiment 5 | 17.0 $\mu g/cm^2$ | 105 Å | 9% |
| Embodiment 6 | 17.0 $\mu g/cm^2$ | 105 Å | 9% |
| Embodiment 7 | 16.8 $\mu g/cm^2$ | 104 Å | 9% |
| Embodiment 8 | 16.7 $\mu g/cm^2$ | 103 Å | 9% |
| Embodiment 9 | 16.9 $\mu g/cm^2$ | 104 Å | 9% |
| Comparative Example 2 | 16.0 $\mu g/cm^2$ | 100 Å | 20% |

Table 2 shows the film thickness and the distribution of the Embodiments 5 through 9 and the Comparative Example 2. As can be seen from the Embodiments and the Comparative Example here, there is little difference, and is about the same. On the other hand, there was difference in the irregularities in the film thickness; i.e., in the inter-device distribution.

This indicates that with the Embodiments there was little decrease in amount of the organic metal compound due to volatilization, etc., even during the drying and baking, because a decomposer was deposited immediately following depositing droplets of the organic metal compound. On the other hand, with the Comparative Example 2, it can be thought that there was loss of volume during the baking process. The difference with the distribution, etc., of Table 1 is thought to come mainly from the manufacturing method of the electrodes.

Embodiment 10

Electron-emitting devices such as shown in FIGS. 1A and 1B were manufactured as electron-emitting devices of the present invention. The following is an description of the electron-emitting devices of the present invention with reference to FIGS. 1A, 1B and 3A through 3E. The reference numerals in FIGS. 1A and 1B are the same as the aforementioned.

Device electrodes 2 and 3 were formed upon an insulating substrate 1 in the same manner as with Embodiment 5, following which an electroconductive film 4 was formed of fine particles (average particle diameter: 58 angstrom) of palladium oxide, using a palladium acetate solution and formic acid, as with Embodiment 5. The fact that the film was formed of palladium oxide was confirmed using X-ray analysis. The electroconductive film 4 here was of 300 μm in width W, and was situated approximately centered between the device electrodes 2 and 3.

Next, as shown in FIG. 3E, an electron-emitting region 5 was manufactured by means of applying voltage between the device electrodes 2 and 3, thereby conducting current conduction treatment to the electroconductive film 4. The voltage waveform for the energization forming is shown in FIG. 4A.

In FIGS. 4A and 4B, T1 and T2 respectively indicate the pulse width and the pulse interval of the voltage waveform; in the present embodiment, T1 was set at 1 ms, T2 was set at 10 ms, the crest value (peak voltage when conducting forming) of the triangular waveform was set at 5V, and the energization forming treatment was conducted in a vacuum atmosphere of approximately $1\times10^{-6}$ torr for 60 seconds.

Further, acetone at $3\times10^{-4}$ torr was introduced into the vacuum apparatus, pulse voltage the same as with forming was applied for 20 minutes, thereby conducting an activation process. Subsequently, the apparatus was excavated to a vacuum, and heat baking was conducted at 200° C. for 10 hours.

500 such devices were manufacturer by means of the above process, and the electron-emitting properties thereof were measured. FIG. 5 shows a schematic construction of the measuring/evaluation apparatus. The reference numerals in FIG. 5 are the same as the aforementioned. With the present embodiment, the distance between the anode electrode and the electron-emitting device was set at 4 mm, the potential of the anode electrode was set at 1 kV, and the degree of vacuum within the vacuum apparatus for when measuring electron emission properties was set at $1\times10^{-8}$ torr.

Using such a measuring/evaluation apparatus, device voltage was applied between the electrodes 2 and 3 of the aforementioned electron-emitting devices, and the device current If and the emission current Ie flowing at that time were measured, the resultant current-voltage properties being shown in FIG. 6. With the devices obtained in this embodiment, the emission current Ie suddenly increased from around device voltage of 8V, and at device voltage of 14V, the device current If was 2.2 mA, and the emission current Ie was 1.1 μA, and an electron-emission efficiency ($\eta$=Ie/If (%)) of 0.05% was obtained.

Embodiment 11

With the present embodiment, an image-forming apparatus was fabricated as follows. The image-forming apparatus of the present invention will be now described with reference to FIGS. 16 and 17.

Figure 16:
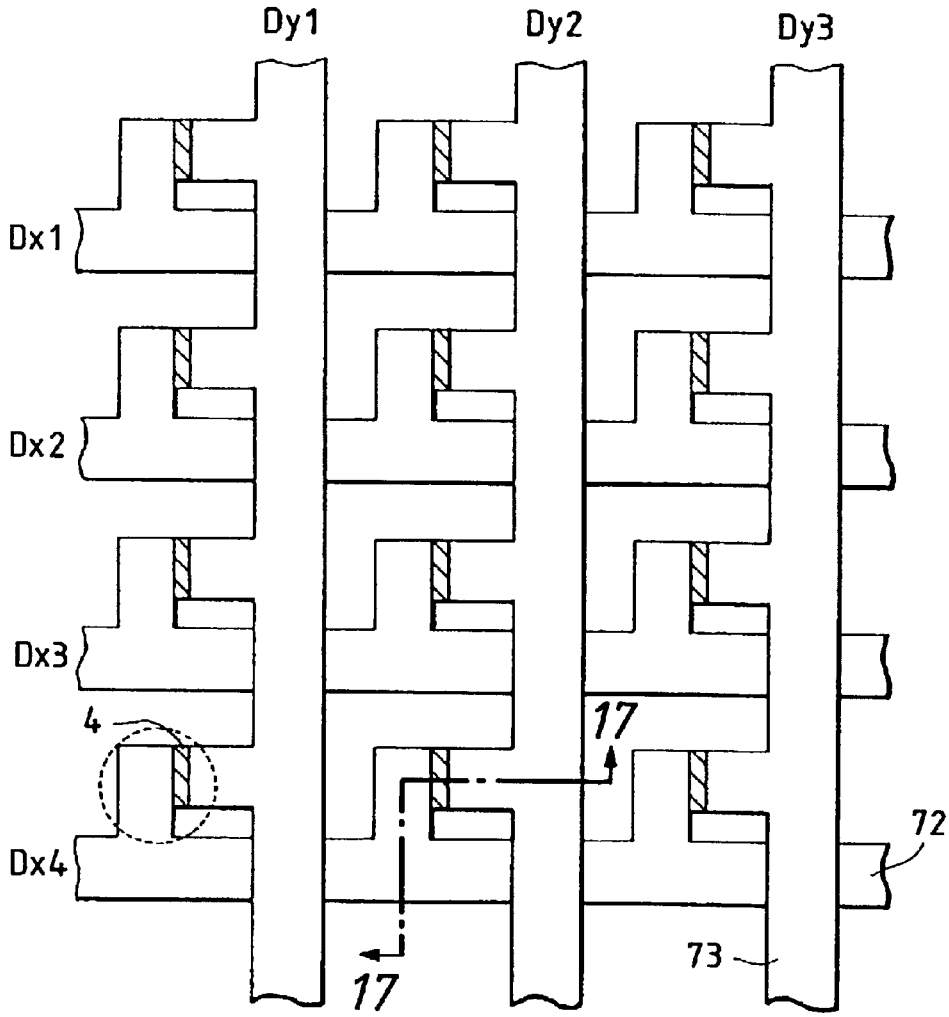
FIG. 16 is a partial plan view of the electron source according to the present invention fabricated in an embodiment.
Figure 17:
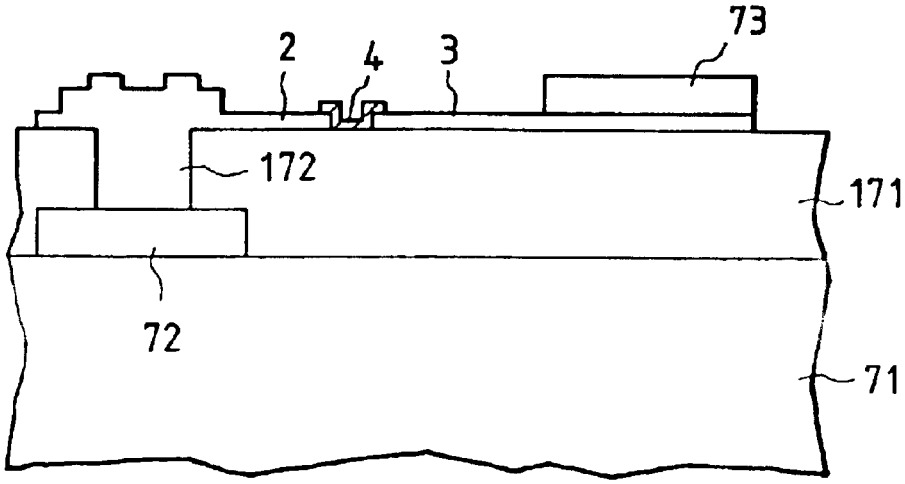
FIG. 17 is a cross-sectional view along line 17—17 of the electron source in FIG. 16.
Figure 18:
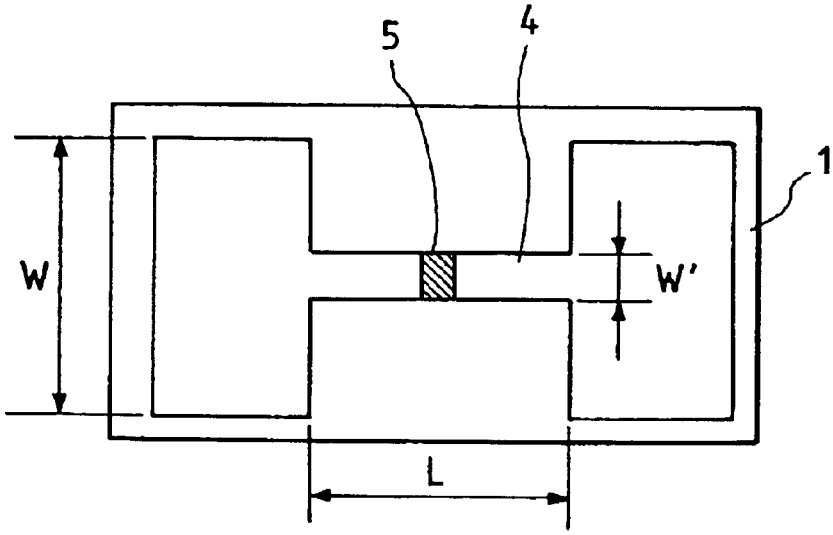
FIG. 18 PRIOR ART
FIG. 18 is a model plan view of a typical construction of a known electron-emitting device.

Part of the electron source is shown from a plan view perspective in FIG. 16, and the cross-sectional view along line 17—17 in FIG. 16 is shown in FIG. 17. The members in FIGS. 16 17 with the same reference numerals indicate the same members. Here, reference numeral 71 denotes an insulating substrate, reference numeral 72 denotes the X-directional wiring corresponding to Dxm in FIG. 7 (also referred to as lower wiring), reference numeral 73 denotes the Y-directional wiring corresponding to Dyn in FIG. 7 (also referred to as upper wiring), reference numeral 4 denotes an electroconductive film, reference numeral 2 and 3 denote device electrodes, reference numeral 171 denotes an inter-layer insulating layer, and reference numeral 172 denotes contact holes for electrical connection of the device electrodes 2 and the lower wiring 72.

Step-a

Upon a substrate 71, formed by forming silicone oxidized film 0.5 μm in thickness by means of sputtering upon a cleansed soda-lime glass plate, were sequentially layered Cr 50 angstrom in thickness and Au 6000 angstrom in thickness, the layering thereof being conducted by vacuum evaporation, following which photoresist (AZ1370, manufactured by Hoechst AG) was applied by means of a spinner, then baked, and exposed to a photo-mask image, then developed, so as to form the register pattern of the lower wiring 72, following which the layered film of Au/Cr was subjected to wet etching, thereby forming the desired lower wiring 72.

Step-b

Next, an inter-layer insulating layer 171 comprised of 1.0 μm of silicone oxidized film was deposited by means of RF sputtering.

Step-c

A photoresist pattern was formed in order to form the contact holes 172 in the silicone oxidized film deposited in Step-b, which was masked and the inter-layer insulating layer 171 was etched so as to form the contact holes 172. The etching was conducted according to a RIE (Reactive Ion Etching) method which uses $CF_4$ and $H_2$ gas.

Step-d

Following this, a pattern to become the inter-device electrode gap L between the electron-emitting device electrodes 2 and 3 was formed with photoresist (RD-2000N-41, manufactured by Hitachi Chemical Co., Ltd.), and 50 angstrom in thickness of Ti and 1000 angstrom in thickness of Ni were sequentially deposited by means of vacuum evaporation. The photoresist pattern was dissolved with an organic solvent, the Ni/Ti deposition film was lifted off, thereby forming device electrodes 2 and 3 with an device electrode spacing of 3 μm and a device electrode width of 300 μm.

Step-e

Following formation of a photoresist pattern for the upper wiring 73 on the device electrodes 2 and 3, 50 angstrom in thickness of Ti and 5000 angstrom in thickness of Au were sequentially deposited by means of vacuum evaporation, the unnecessary portions were removed by means of lifting off, thereby forming the upper wiring 73 in the desired form.

Step-f

Next, in the same manner as with Embodiment 10, a solution of organic metal compound (palladium acetate), and formic acid were deposited as droplets, and a heat treatment process was applied thereof, thereby obtaining an electroconductive film in the same manner as with Embodiment 10.

Step-g

A pattern was formed such that resist was coated on portions excluding the contact hole 172 portions, following which 50 angstrom in thickness of Ti and 5000 angstrom in thickness of Au were sequentially deposited by means of vacuum evaporation. The unnecessary portions were removed, thereby embedding the contact holes 172.

According to the above-described steps, lower wiring 72, an inter-layer insulating layer 171, upper wiring 73, device electrodes 2 and 3, electroconductive film 4, etc. were formed upon an insulating substrate 71.

Next, a display panel was constructed using the electron source fabricated as described above. The manufacturing method of the display panel of the image-forming apparatus according to the present invention will now be described with reference to FIGS. 8, 9A and 9B. The reference numerals in either of the Figures are the same as described above.

Following fixing of a substrate 71 onto a rear plate 81, upon which substrate many flat-type electron-emitting devices were arrayed as described above, a face plate 86 (comprised of a fluorescent screen 84 and a metal back 85 formed on the inner side of the glass substrate 83) was situated 5 mm above the substrate 71 with a frame 82 situated in between, wherein the connecting portions of the face plate 86, the rear plate 81, and the frame 82 were coated with frit glass and then baked at 400° C. for 10 minutes or more in an ambient atmosphere, thereby sealing the assembly (FIG. 8). The fixing of the rear plate 81 to the substrate 71 was also conducted employing frit glass. In FIG. 8, reference numeral 74 corresponds to the electron emitting region, and reference numerals 72 and 73 receptively denote the X-directional wiring and Y-directional wiring.

The fluorescent screen 84 is comprised of fluorescent substance alone in the event that the fluorescent screen is to be used for monochrome only, but in the case of the present embodiment, stripped fluorescent substance was employed, wherein the black striping was formed first, and each of the fluorescent substances was coated in the spacing in between, so as to form the fluorescent screen 84. As for the material comprising the black striping, a well-used material with graphite as the primary ingredient was employed, and the slurry method was used to coat the fluorescent substance to the glass substrate 83.

A metal back 85 is usually provided on the inner side of the fluorescent screen 84. The metal back was be manufactured following manufacturing of the fluorescent film by means of a graduation process (generally referred to as "filming") of the inner surface of the fluorescent film, following which deposition is conducted by means of deposition of Al employing vacuum evaporation, etc.

Regarding the face plate 86, while a transparent electrode (not shown) may be provided to the outer side of the fluorescent film 84 in order to further increase the conductivity of the fluorescent film 84, sufficient conductivity was obtained with the metal back of the present embodiment, so that this was omitted.

Upon conducting the aforementioned sealing, sufficient positioning was conducted, as each of the fluorescent substances must be corresponded with the electron-emitting devices in the case of color.

The atmosphere within the glass container (envelope) is drawn to a sufficient vacuum by means of the exhaust tube (unshown), and is sealed. Subsequently, voltage was applied between the electrodes 2 and 3 of the electron-emitting devices 74 via external terminals Dox1 through Doxm and Doy1 through Doyn, and the electron-emitting region 5 was manufactured by means of conducting current conduction treatment (forming treatment) to the electroconductive film 4. The voltage waveform to be used for forming treatment is shown in FIG. 4A.

In FIGS. 4A and 4B, T1 and T2 respectively indicate the pulse width and the pulse interval of the voltage waveform; in the present embodiment, T1 was set at 1 ms, T2 was set at 10 ms, the crest value (peak voltage when conducting forming) of the triangular waveform was set at 5V, and the energization forming treatment was conducted in a vacuum atmosphere of approximately $1\times10^{-6}$ torr for 60 seconds.

Further, acetone at $10^{-3}$ torr was introduced into the vacuum apparatus, pulse voltage the same as with forming was applied for 15 minutes, thereby conducting an activation process. Subsequently, the apparatus was excavated to a sufficient vacuum, and heat baking was conducted at 200° C. for 5 hours.

Then, the unshown vacuum tube was welded by means of a gas burner, thereby sealing the envelope.

Finally, getter processing was conducted in order to maintain the vacuum of the envelope following sealing. This was conducted by heating a getter positioned at a predetermined position (unshown) of the display panel, employing a high-frequency heating method, thereby forming a vacuum evaporation film, the above process being conducted prior to conducting sealing. The main ingredient of the getter used was Ba.

An image-forming apparatus was formed using the image display apparatus thus completed (the drive circuit not shown), wherein electron emission was caused by means of applying scanning signals and modulation signals to each of the electron-emitting devices by means of unshown signal generating means via external terminals Dox1 through Doxm, and Doy1 through Doyn, and the electron beam is accelerated by means of applying high voltage of 5 kV or greater to the metal back 85 via the high-voltage terminal Hv, thereby causing the electron beam to collide with the fluorescent film 84 so as to excite the fluorescent film 84 which causes luminous emission, consequently displaying an image.

Comparative Example 2

An image-forming apparatus was formed in the same manner as with Embodiment 11 except that no deposition of formic acid which is a decomposer was conducted in Step (f). Next, the brightness and brightness distribution of the Embodiment 11 and the Comparative Example 2 were measured. The measurement of brightness was conducted by causing luminous emission of the image-forming apparatuses in dot sequence, using a well-used CCD photoreceptor. In Embodiment 11, the average brightness was 70 fL, and the brightness distribution was 8%. On the other hand, with the Comparative Example 2, the average brightness was 60 fL, and the brightness distribution was 25%.

As can be seen from the above, depositing droplets of a decomposer immediately following deposition of the organic metal compound material of the electroconductive film 4 results in improvement not only of the brightness distribution within the image of the image-forming apparatus, but also an improvement in average brightness; i.e., it can be deduced that with the present embodiment in which droplets of a decomposer are deposited immediately following deposition of the organic metal compound material of the electroconductive film 4, a certain time for drying the droplets of the organic metal compound can be appropriately set according to the constituency of the organic metal compound, this drying time being the amount of time from which the organic metal compound is deposited to the subsequent deposition of the decomposer, during which time the organic metal compound is dried, so that partial crystallization or distribution of the organic metal compound is inhibited, thereby improving the brightness and the distribution thereof. On the other hand, it can be deduced that within the Comparative Example in which the time following deposition of the organic metal compound till the subsequent baking process differs from one device to another, partial crystallization or distribution of the organic metal compound occurs, which is then reflected in the brightness and the distribution thereof.

Embodiment 12

An image forming apparatus was formed in the same manner as with Embodiment 11 except Step (d) and Step (f). A printing paste was printed for the device electrodes in the same manner as Embodiment 1. Further, in Step (f), an aqueous solution of polyvinyl alcohol, which is an aqueous resin, was deposited prior to the deposition of the solution of the organic metal compound and deposition of formic acid. Next, the brightness and brightness distribution thereof were measured as with Embodiment 11 and the Comparative Example 2. In the present embodiment, the average brightness was 68 fL, and the brightness distribution was 9%. Reasons why the distribution thereof became markedly smaller than the film thickness distribution indicated in Table 1 include the following: in the manufacturing method of the electron-emitting device of the present invention, the processes for solving film thickness distribution, or the film thickness, are not directly being reflected in the device properties distribution, etc.

As can be seen from the above, regarding the manufacturing method of a pair of electrodes formed on a substrate in an opposing manner, the conducted processes of filling the porous holes in the device electrodes beforehand by means of depositing an aqueous solution of aqueous resin, and then conducting deposition of the electroconductive film forming material and deposition of a decomposer results in improvement not only of the brightness distribution within the image of the image-forming apparatus, but also an improvement in average brightness, regardless of whether the device electrodes are formed by offset printing employing printing paste, or screen printing.

Effects of the Present Invention

In known electron sources and image-forming apparatuses, especially in those of great area, there have been problems in the manufacturing process of the electron-emitting devices such as irregularity in the film thickness of the electroconductive film forming material, and further, irregularity in electron-emission properties, and irregularity in brightness in the image-forming apparatus; the causes of these problems being as follows:

(1) Formation of non-uniform crystals of the electroconductive film forming material in the processes beginning with the drying process of the electroconductive film forming material to the baking process thereof; and evaporation or sublimation of the electroconductive film forming material in the baking process purposed to conduct heat decomposition of the electroconductive film forming material necessary to provide the electroconductive film forming material with conductivity.

(2) Occurrence of irregularities in the form of droplets of electroconductive film forming material in the process of depositing the electroconductive film forming material onto the substrate, in the event that the surface energy of the surface of the substrate is not controlled.

(3) Regarding the manufacturing method of a pair of electrodes formed on a substrate in an opposing manner, the device electrodes have many porous holes therewithin due to the device electrodes being formed by offset printing employing printing paste, or screen printing; thus causing adsorption of the electroconductive film forming material, resulting in loss of volume of the electroconductive film forming material.

According to the manufacturing method of the electron-emitting device of the present invention wherein there is conducted deposition of electroconductive film forming material, a decomposer for the electroconductive film forming material, and/or aqueous resin, to the substrate and/or part or all of the device electrode:

the cause of aforementioned (1) is solved by the electroconductive film forming material to the substrate, and the cause of the aforementioned (2) and (3) are solved by means of the aqueous resin applied to the substrate controlling the surface energy of the surface of the substrate; that is, the area to which the droplets are deposited is limited by means of the aqueous resin applied to the substrate; and further, the aforementioned (3) is solved by means of depositing aqueous resin to part or all of the device electrode, thereby filling in the many porous holes formed therewithin due to formation by offset printing employing printing paste, or screen printing. Consequently, the problems in the manufacturing process of the electron-emitting devices for known electron sources and image-forming apparatuses, especially in those of great area, such as irregularity in the film thickness of the electroconductive film forming material, and further, irregularity in electron-emission properties, and irregularity in brightness in the image-forming apparatus, have been solved, and an electron source and image-forming apparatus of great area with good properties have been provided, without employing photo-lithographic technology.

What is claimed is:

1. A method for manufacturing an image displaying apparatus comprising a substrate, an electroconductive element disposed on the substrate, and a thin film element disposed on the electroconductive element, the method comprising the steps of:

(a) applying to the electroconductive element a liquid including a component constituting the thin film element according to an ink jet method; and (b) applying to the electroconductive element another liquid including resin according to an ink jet method, wherein step (a) is performed after step (b), to apply the liquid including the component constituting the thin film element onto the resin.

2. A method for manufacturing an image displaying apparatus comprising a substrate, an electroconductive element disposed on the substrate, and a thin film element, in which electrons are flowed, disposed on the electroconductive element, the method comprising the steps of:

(a) applying to the electroconductive element a liquid including a component constituting the thin film element according to an ink jet method; and (b) applying to the electroconductive element another liquid including resin according to an ink jet method, wherein step (a) is performed after step (b), to apply the liquid including the component constituting the thin film element onto the resin.

* * * * *

UNITED STATES PATENT AND TRADEMARK OFFICE

CERTIFICATE OF CORRECTION

PATENT NO. : 6,946,159 B2
APPLICATION NO. : 10/236935
DATED : September 20, 2005
INVENTOR(S) : Yasuo Takahashi et al.

It is certified that error appears in the above-identified patent and that said Letters Patent is hereby corrected as shown below:

ON COVER PAGE AT (56) FOREIGN PATENT DOCUMENTS

| | | | | |
|---|---|---|---|---|
| "JP | 1283749 | 5/1998" should read --JP | 1-283749 | 11/1998--; |
| "JP | 64031332 | 2/1989" should read --JP | 64-31332 | 2/1989--; |
| "JP | 2257552 | 3/1989" should read --JP | 2-257552 | 10/1990--; and |
| "JP | 1200532 | 8/1989" should read --JP | 1-200532 | 8/1989--. |

ON COVER PAGE AT (75) INVENTORS

"Naoko Miura, Kanagawa-Ken (JP) should read --Naoko Miura, Kawasaki (JP)--.

ON COVER PAGE AT (56) REFERENCES CITED

After "C.A. Spindt et al.,": "C nes"." should read --Cones".--.

COLUMN 2

Line 16, "one" should read --is one--; and
Line 47, "lightning" should read --lighting--.

COLUMN 3

Line 27, "phenomena" should read --phenomenon--.

COLUMN 4

Line 8, "on" should read --in--.

COLUMN 5

Line 49, "buble-jet" should read --bubble-jet--.

COLUMN 6

Line 18, "reproducability," should read --reproducibility,--.

COLUMN 7

Line 47, "the order" should read --¶ the order--.

UNITED STATES PATENT AND TRADEMARK OFFICE

CERTIFICATE OF CORRECTION

PATENT NO. : 6,946,159 B2
APPLICATION NO. : 10/236935
DATED : September 20, 2005
INVENTOR(S) : Yasuo Takahashi et al.

It is certified that error appears in the above-identified patent and that said Letters Patent is hereby corrected as shown below:

COLUMN 8

Line 27, “reproducability,” should read --reproducibility,--.

COLUMN 9

Line 49, “When” should read --With--.

COLUMN 10

Line 19, “that there” should read --there--; and
Line 62, “almina,” should read --alumina,--.

COLUMN 11

Line 52, “over lapping” should read --overlapping--.

COLUMN 12

Line 10, “posses” should read --possess--.

COLUMN 13

Line 41, “rectangular.” should read --rectangular may be used.--.

COLUMN 17

Line 4, “voltage” should read --when the voltage--.

COLUMN 18

Line 15, “further” should be deleted.

COLUMN 19

Line 3, “receptively” should read --respectively--.

COLUMN 20

Line 53, “an” should read --a--.

UNITED STATES PATENT AND TRADEMARK OFFICE

CERTIFICATE OF CORRECTION

PATENT NO. : 6,946,159 B2
APPLICATION NO. : 10/236935
DATED : September 20, 2005
INVENTOR(S) : Yasuo Takahashi et al.

It is certified that error appears in the above-identified patent and that said Letters Patent is hereby corrected as shown below:

COLUMN 24

Line 16, “matter” should read --manner--;
Line 41, “And” should read --An--; and
Line 58, “and following through” should read --and following thorough--.

COLUMN 25

Line 17, “results” should read --result--;
Line 20, “reproducability.” should read --reproducibility.--; and
Line 22, “reproducability.” should read --reproducibility.--.

COLUMN 26

Line 27, “describe” should read --described--;
Line 31, “rectangular.” should read --rectangular may be used.--; and
Line 67, “through” should read --thorough--.

COLUMN 27

Line 3, “was” should read --were--;
Line 18, “phenomena” should read --phenonemon--;
Line 28, “results” should read --result--;
Line 64, “and” should read --an--; and “was” should read --were--.

COLUMN 28

Line 17, “each” should read --on each--; and
Line 46, “through” should read --thorough--.

COLUMN 29

Line 31, “were” should read --was--.

COLUMN 30

Line 56, “an” should read --a--.

COLUMN 31

Line 2, “of” should be deleted; and
Line 24, “manufacturer” should read --manufactured--.

UNITED STATES PATENT AND TRADEMARK OFFICE

CERTIFICATE OF CORRECTION

PATENT NO. : 6,946,159 B2
APPLICATION NO. : 10/236935
DATED : September 20, 2005
INVENTOR(S) : Yasuo Takahashi et al.

It is certified that error appears in the above-identified patent and that said Letters Patent is hereby corrected as shown below:

COLUMN 32

Line 38, “an” should read --a--; and
Line 54, “thereof,” should read --thereto,--.

COLUMN 33

Line 28, “stripped” should read --striped--.

Signed and Sealed this

Second Day of October, 2007

JON W. DUDAS
*Director of the United States Patent and Trademark Office*